US009131779B2

(12) United States Patent
Jin

(10) Patent No.: US 9,131,779 B2
(45) Date of Patent: Sep. 15, 2015

(54) FOLDABLE BED FRAME

(71) Applicant: Ki Ho Jin, Xiamen (CN)

(72) Inventor: Ki Ho Jin, Xiamen (CN)

( * ) Notice: Subject to any disclaimer, the term of this patent is extended or adjusted under 35 U.S.C. 154(b) by 0 days.

(21) Appl. No.: 14/259,368

(22) Filed: Apr. 23, 2014

(65) Prior Publication Data

US 2014/0298583 A1 Oct. 9, 2014

Related U.S. Application Data

(63) Continuation of application No. 13/495,407, filed on Jun. 13, 2012, now Pat. No. 8,707,478, which is a continuation-in-part of application No. 13/316,077, filed on Dec. 9, 2011, now Pat. No. 8,910,327, which is a continuation-in-part of application No. 12/655,565, filed on Dec. 30, 2009, now Pat. No. 8,091,160.

(30) Foreign Application Priority Data

Mar. 17, 2009 (CN) ..... 2009 2 0137197 U
Dec. 20, 2011 (CN) ..... 2011 2 0536757 U

(51) Int. Cl.
*A47C 19/12* (2006.01)
*A47C 19/04* (2006.01)

(52) U.S. Cl.
CPC ..... *A47C 19/124* (2013.01); *A47C 19/04* (2013.01); *A47C 19/126* (2013.01); *A47C 19/128* (2013.01)

(58) Field of Classification Search
CPC .... A47C 19/04; A47C 19/124; A47C 19/126; A47C 19/12; A47C 19/128
USPC ..... 5/112–117, 174–185, 200.1–202
See application file for complete search history.

(56) References Cited

U.S. PATENT DOCUMENTS 589,482 A 9/1897 Rimmelin
613,499 A 11/1898 Curry
648,304 A 4/1900 Routier
(Continued)

FOREIGN PATENT DOCUMENTS

CN 2376227 Y 5/2000
CN 2684640 Y 3/2005
(Continued)

OTHER PUBLICATIONS

International Search Report, PCT/CN2007/001842, Dec. 25, 2007.

*Primary Examiner* — Peter M Cuomo
*Assistant Examiner* — Ifeolu Adeboyejo
(74) *Attorney, Agent, or Firm* — John H. Choi

(57) ABSTRACT

An foldable bed frame including a plurality of longitudinal beams spaced apart and parallel to each other. Each longitudinal beam is formed by a pair of longitudinal bars that are pivotally connected together. The bed frame also includes a plurality of transverse beams spaced apart and parallel to each other. Each transverse beam is formed by a pair of transverse bars that are pivotally connected together. Each transverse bar has a first sliding member slidingly coupled with a second sliding member for adjusting the bed frame to predetermined widths. The bed frame also includes legs connected to a corresponding lower side of each longitudinal bar free end. The longitudinal and transverse bars are coupled together to form a generally rectangular frame when the bed frame is in an open configuration, and are folded adjacent and parallel to each other when the bed frame is in a folded configuration.

10 Claims, 27 Drawing Sheets

(56) References Cited

U.S. PATENT DOCUMENTS

| | | | | | |
|---|---|---|---|---|---|
| 718,159 | A | | 1/1903 | Rundgvist | |
| 810,718 | A | | 1/1906 | Clark | |
| 860,938 | A | | 7/1907 | Richards | |
| 947,133 | A | | 1/1910 | Shelto | |
| 1,100,701 | A | | 6/1914 | Kreuzkamp | |
| 1,122,284 | A | | 12/1914 | Kyle | |
| 1,129,089 | A | | 2/1915 | Hajas | |
| 1,167,123 | A | | 1/1916 | Sinclair | |
| 1,204,792 | A | | 11/1916 | Kyle | |
| 1,259,148 | A | | 3/1918 | Slutts | |
| 1,323,257 | A | | 12/1919 | Dudek | |
| 1,394,331 | A | | 10/1921 | Monroe | |
| 1,409,380 | A | | 3/1922 | Irwin et al. | |
| 1,434,962 | A | * | 11/1922 | Purcell | 5/112 |
| 1,577,204 | A | | 3/1926 | Davis | |
| 1,577,205 | A | | 3/1926 | Davis | |
| 1,602,115 | A | | 10/1926 | Malis | |
| 1,693,537 | A | | 11/1928 | Adkins et al. | |
| 1,763,447 | A | | 6/1930 | Schilling | |
| 1,810,311 | A | | 6/1931 | Frey | |
| 1,876,743 | A | | 9/1932 | Pilates | |
| 2,239,951 | A | | 4/1941 | Bromschwig | |
| 2,550,224 | A | | 4/1951 | Clerc | |
| 2,590,129 | A | | 3/1952 | Kalil | |
| 2,591,551 | A | | 4/1952 | Kaplan | |
| 2,611,907 | A | * | 9/1952 | Clerc | 5/176.1 |
| 2,650,657 | A | * | 9/1953 | Ohlsson | 297/440.23 |
| 3,044,080 | A | * | 7/1962 | Hartwig | 5/111 |
| 3,579,674 | A | * | 5/1971 | Blais | 5/94 |
| 3,761,970 | A | | 10/1973 | Fredman | |
| 3,824,638 | A | | 7/1974 | Bogar, Jr. | |
| 3,881,202 | A | | 5/1975 | Tyhanic | |
| 3,967,330 | A | | 7/1976 | Zawadowsky | |
| 4,070,717 | A | | 1/1978 | Kitchen et al. | |
| 4,106,141 | A | | 8/1978 | Hooker | |
| 4,225,265 | A | * | 9/1980 | Hooker et al. | 403/353 |
| 4,243,263 | A | | 1/1981 | Thiboutot | |
| 4,670,921 | A | | 6/1987 | Avni et al. | |
| 4,679,261 | A | | 7/1987 | Stanley et al. | |
| 5,265,289 | A | * | 11/1993 | Swiger et al. | 5/111 |
| 5,711,040 | A | | 1/1998 | Huang | |
| 5,718,254 | A | | 2/1998 | Murphy | |
| 5,911,653 | A | | 6/1999 | Cheng | |
| 5,996,145 | A | | 12/1999 | Taylor | |
| 6,134,727 | A | | 10/2000 | Hwang | |
| 6,338,172 | B1 | | 1/2002 | Taylor et al. | |
| 6,397,412 | B1 | | 6/2002 | Quintile | |
| 6,553,586 | B1 | | 4/2003 | Lin | |
| 6,581,223 | B1 | | 6/2003 | Wang | |
| 6,618,879 | B1 | | 9/2003 | Wu | |
| 6,810,540 | B2 | | 11/2004 | Harrow | |
| 7,134,154 | B2 | | 11/2006 | Cloer et al. | |
| 7,690,058 | B1 | | 4/2010 | Dwyer et al. | |
| 8,091,160 | B2 | | 1/2012 | Jin | |
| 8,407,837 | B1 | * | 4/2013 | Huang et al. | 5/620 |
| 2003/0200608 | A1 | * | 10/2003 | Polevoy et al. | 5/201 |
| 2006/0174415 | A1 | | 8/2006 | Moulton | |
| 2008/0168602 | A1 | | 7/2008 | DiForio | |
| 2010/0299831 | A1 | | 12/2010 | Lee | |
| 2012/0246826 | A1 | | 10/2012 | Jin | |
| 2012/0304380 | A1 | | 12/2012 | Jin | |

FOREIGN PATENT DOCUMENTS

| | | | |
|---|---|---|---|
| CN | 2902036 | Y | 5/2007 |
| GB | 2240034 | A | 7/1991 |
| GB | 2360700 | A | 10/2001 |
| JP | 4073008 | A | 3/1992 |

* cited by examiner

FOLDABLE BED FRAME

CROSS REFERENCES TO RELATED APPLICATIONS

This application is a continuation of U.S. application Ser. No. 13/495,407, filed on Jun. 13, 2012, which is a continuation-in-part of U.S. application Ser. No. 13/316,077, filed on Dec. 9, 2011, which is a continuation-in-part of U.S. application Ser. No. 12/655,565, filed on Dec. 30, 2009, now U.S. Pat. No. 8,091,160, issued on Jan. 10, 2012, all of which are incorporated by reference in their entireties.

FIELD OF THE INVENTION

The present invention relates to the field of bed support frames for supporting mattresses, and more particularly to bed frames that are adjustable to fit and support a range of mattress sizes. The present invention also relates to bed frames that are capable of being folded into a compact state for convenient transport and storage.

BACKGROUND OF THE INVENTION

Conventional beds generally include a frame, a box spring that is supported by the frame and a mattress that rests on top of the box spring. Conventional frames generally consist of a head rail, foot rail and two pairs of spaced, parallel side rails that form a rectangle that conforms to the shape of the box spring to be placed thereon. The rails support the outer periphery of the box spring mattress.

Although sufficient for most smaller beds, the rectangular configuration fails to sufficiently support the center of most larger beds, such as queen or king-sized beds. Most of the weight of a sleeper rests on the center portion of the bed and a lack of support in the center portion can result in bowing of the mattress and instability. Such bowing and instability of the mattress can result in discomfort for the sleeper and excessive wear on the mattress and bed frame.

Therefore, bed frames are sold with separate cross-rail supports to provide support to the center portion of the bed. One or more metal cross-rail supports are assembled to rest on the side rails of the frame and extend along the width of the bed, or on the head rail and foot rail and extend along the length of the bed. Further support for the mattress may be achieved by using a leg, or legs, attached to the cross-rail. The legs rest on the floor and are located beneath the support zone of the bed, supporting the cross-rail from below.

Furthermore, to accommodate the large number of bed widths, the cross-rail supports (and head rail and foot rail) are adjustable to allow the transverse cross-rail supports (and head rail and foot rail) to be lengthened or shortened to support different sized beds.

Even though the cross-rail supports are adjustable, the length of the side rails, which may exceed six feet, cannot be adjusted. Therefore, the bed frames are packaged and sold with a minimum length of six feet or longer. Such packaging causes great inconvenience. For example, the retailer must dedicate much needed additional valuable shelf space for the product. As another example, transporting the product is difficult for the consumer because of its length. In other words, transport of the product is not possible in a trunk of an automobile and therefore the consumer is required to have a larger vehicle or have the bed frame shipped, incurring additional shipping costs. As yet another example, storing the product when the bed frame is not in use is difficult because of the length of the frame.

Another problem with conventional bed frames occurs during the process of adjusting the width of the bed frame. The cross-rail supports of conventional bed frames must be assembled and adjusted while the bed frame is fully opened. It is often times difficult to adjust the width of each cross-rail support due to the geometrical constraints of the bed frame.

Therefore, it would be advantageous to have a bed frame capable of compact folding for easy transport and storage. Furthermore, it would be advantageous if the width of the bed frame was easy to adjust.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention addresses the above needs and achieves other advantages by providing an easily adjustable bed frame capable of reducing its structural components to a significantly more compact arrangement by folding or otherwise collapsing the metal bed frame into a configuration having a reduced size, so that the folded frame occupies minimal space during storage and/or transportation, which can further reduce costs to the retailer and consumer.

In order to achieve the above advantages, the present invention provides a foldable bed frame comprising: first, second and third longitudinal beams spaced apart and parallel to each other, the third longitudinal beam positioned between the first and second longitudinal beams, each longitudinal beam formed by first and second longitudinal bars each having a first end and a second end, adjacent first ends of each first and second longitudinal bars pivotally connected together; first and second transverse beams spaced apart and parallel to each other, each transverse beam formed by a pair of transverse bars having a first end and a second end, adjacent first ends of each pair of transverse bars pivotally connected together, opposing transverse bar second ends of each transverse beam pivotally connected to longitudinal bar second ends of opposing first and second longitudinal beams to form a generally rectangular frame forming an inner space therebetween when the bed frame is in an open configuration; and a plurality of legs, wherein each of the plurality of legs is coupled to a corresponding lower side of each longitudinal bar proximate the second ends and extending downward therefrom.

In another aspect, the present invention provides a foldable bed frame comprising: first, second and third longitudinal beams spaced apart and parallel to each other, the third longitudinal beam positioned between the first and second longitudinal beams, each longitudinal beam formed by first and second longitudinal bars each having a first end and a second end, adjacent first ends of each first and second longitudinal bars pivotally connected together; first and second transverse beams spaced apart and parallel to each other, each transverse beam formed by a pair of transverse bars having a first end and a second end, adjacent first ends of each pair of transverse bars pivotally connected together, opposing transverse bar second ends of each transverse beam pivotally connected to longitudinal bar second ends of opposing first and second longitudinal beams to form a generally rectangular frame forming an inner space therebetween when the bed frame is in an open configuration; and a plurality of legs, wherein each of the plurality of legs is coupled to a corresponding lower side of each longitudinal bar proximate the second ends and extending downward therefrom, wherein each of the plurality of legs comprises a leg member having an elongated channel with opposing ends.

In yet another aspect, the present invention provides a foldable bed frame comprising: first, second and third longitudinal beams spaced apart and parallel to each other, the third longitudinal beam positioned between the first and second longitudinal beams, each longitudinal beam formed by first and second longitudinal bars each having a first end and a second end, adjacent first ends of each first and second longitudinal bars pivotally connected together by a first pivotal coupling member; first and second transverse beams spaced apart and parallel to each other, each transverse beam formed by a pair of transverse bars having a first end and a second end, adjacent first ends of each pair of transverse bars pivotally connected together by a second pivotal coupling member, opposing transverse bar second ends of each transverse beam pivotally connected to longitudinal bar second ends of opposing first and second longitudinal beams by a third pivotal coupling member to form a generally rectangular frame forming an inner space therebetween when the bed frame is in an open configuration; and a plurality of legs, wherein each of the plurality of legs is coupled to a corresponding lower side of each longitudinal bar proximate the second ends and extending downward therefrom; wherein the bed frame is folded from the open configuration to a folded configuration by: rotating each of the plurality of legs towards its corresponding longitudinal bar; rotating downward, with respect to respective second pivotal coupling members, each pair of unfolded transverse bars of each of the first and second transverse beams to be folded; rotating downward, with respect to respective third pivotal coupling members, each pair of folded transverse bars towards the first and second longitudinal beams to fold the longitudinal bars of the third longitudinal beam; and collectively rotating the opposing longitudinal bars of the first and second longitudinal beams and the folded transverse beams toward the folded longitudinal bars of the folded third longitudinal beam such that the transverse bars and the longitudinal bars are collectively substantially parallel and adjacent to each other.

BRIEF DESCRIPTION OF THE DRAWINGS

Further advantages and features of the present invention will become apparent from the detailed description of the invention with reference to the accompanying drawings, in which.

Figure 1:
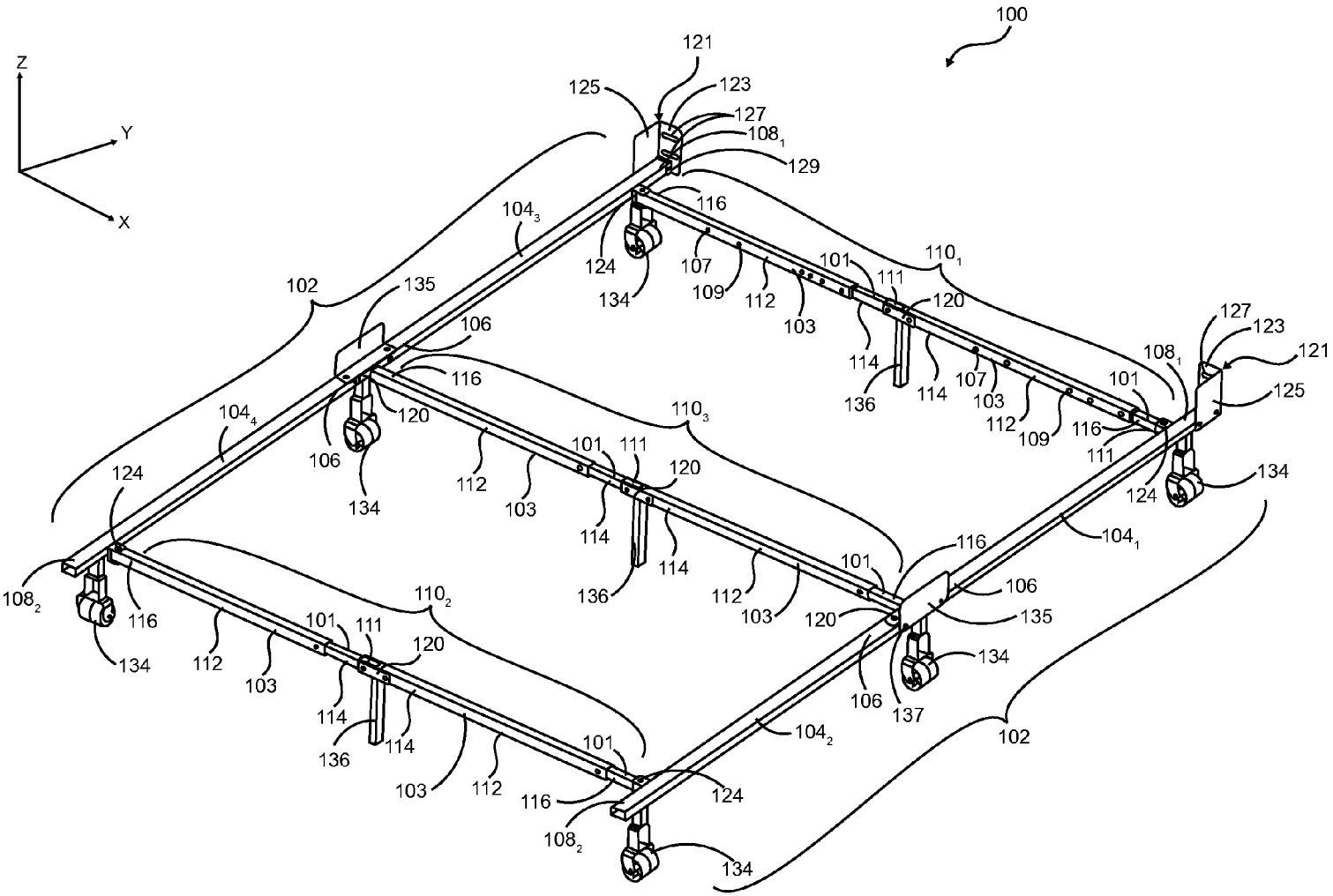
FIG. 1 is a top perspective view illustrating a first embodiment of an adjustable folding bed frame of the present invention in a completely expanded state.

To facilitate an understanding of the invention, identical reference numerals and component descriptions have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Exemplary embodiments are described herein to provide a detailed description of the invention. Variations of these embodiments will be apparent to those of skill in the art.

First Embodiment

Figure 3:
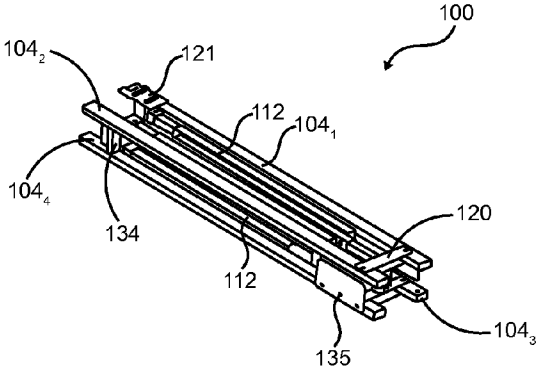
FIG. 3 is a perspective view illustrating the bed frame of FIG. 1 in a fully collapsed state.
Figure 2:
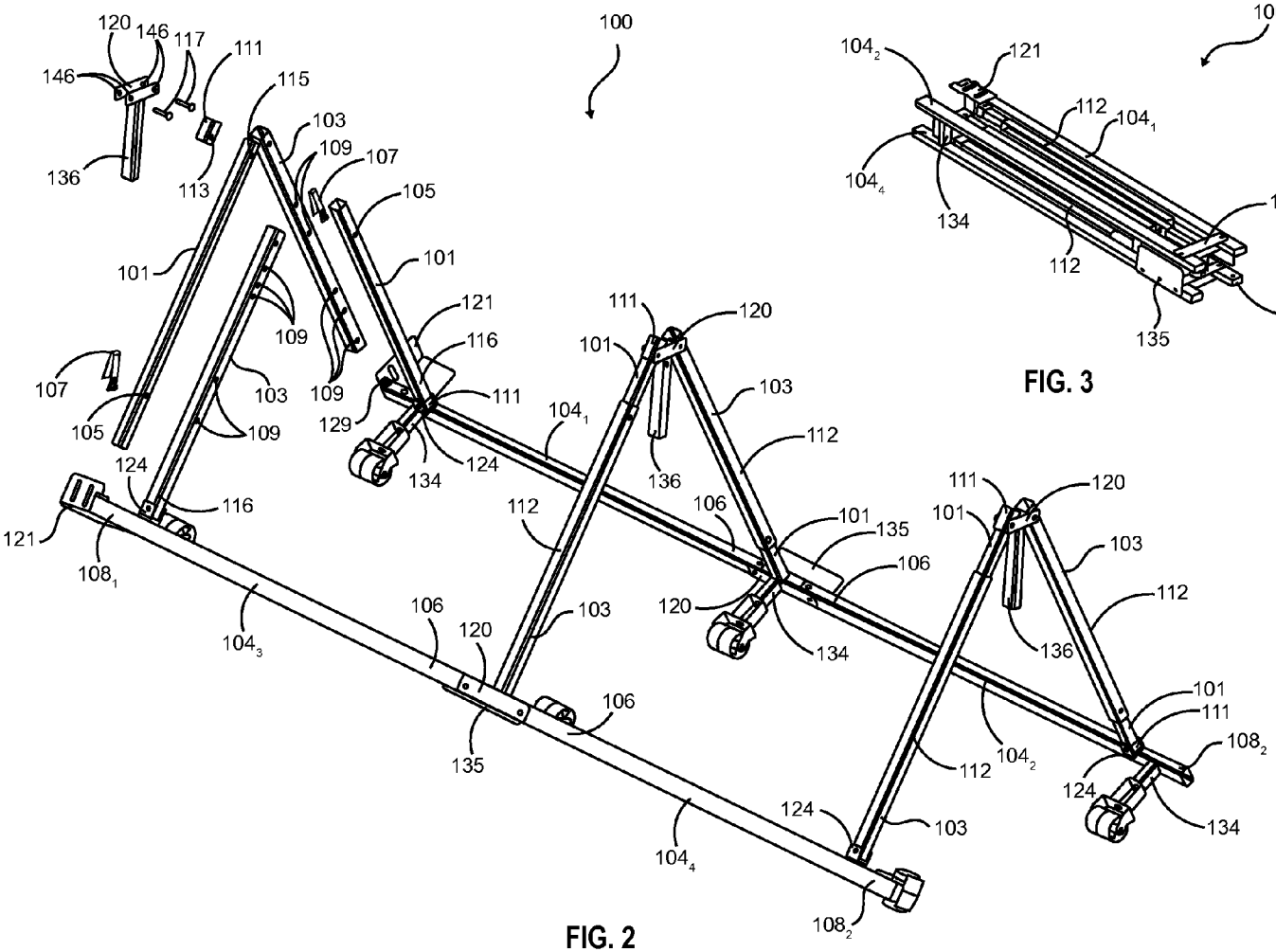
FIG. 2 is a top perspective view illustrating the bed frame of FIG. 1 in a partially collapsed state, and includes an exploded view of a transverse beam.

Referring to FIG. 1, a first embodiment of an adjustable folding bed frame 100 of the present invention in a fully open configuration is shown. FIGS. 2-3 illustrate how the bed frame 100 can be easily folded into a significantly reduced size for convenient transport and/or storage. The bed frame 100 comprises a pair of longitudinal beams 102, three transverse beams $\mathbf{110}_1$, $\mathbf{110}_2$ and $\mathbf{110}_3$ (collectively, "110") and at least four legs 134, 136 (e.g., nine legs shown). The beams and legs 102, 110, 134, 136 are formed with metal and are of rectangular hollow shape to reduce weight while maintaining strength, but one of ordinary skill in the art will recognize that other materials and shapes could be used without departing from the spirit and scope of the invention.

As illustratively shown in its open configuration of FIG. 1, the three transverse beams 110 are spaced apart substantially equidistant from each other and each end is coupled normal to the longitudinal beams 102 to form a substantially rectangular bed frame 100. Specifically, a first transverse beam $\mathbf{110}_1$ is coupled between opposing first ends (i.e., free ends $\mathbf{108}_1$) of the longitudinal beams 102, and a second transverse beam $\mathbf{110}_2$ is coupled between opposing second ends (i.e., free ends $\mathbf{108}_2$) of the longitudinal beams 102. Preferably, a third transverse beam $\mathbf{110}_3$ is coupled centrally between the first and second ends $\mathbf{108}_1$, $\mathbf{108}_2$ (collectively, "108") of the longitudinal beams 102.

Figure 4:
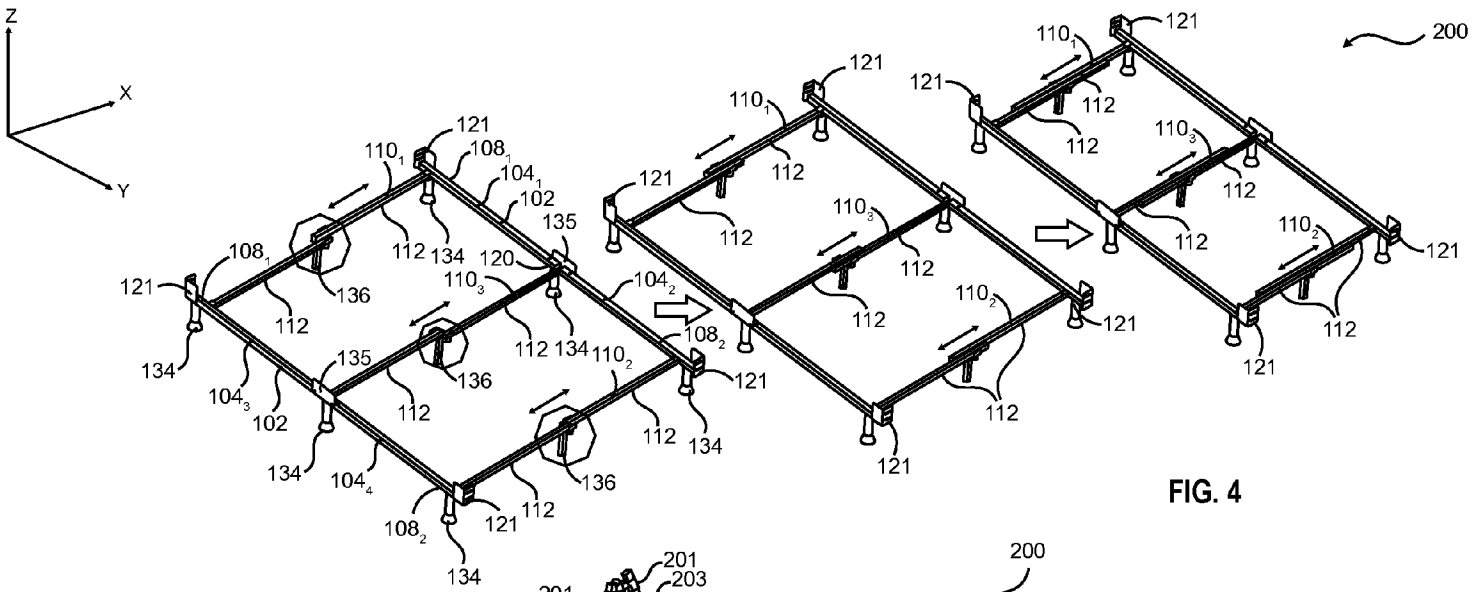
FIG. 4 are top perspective views illustrating a second embodiment of an adjustable folding bed frame of the present invention in a completely expanded state, in three different adjusted widths.
Figure 5:
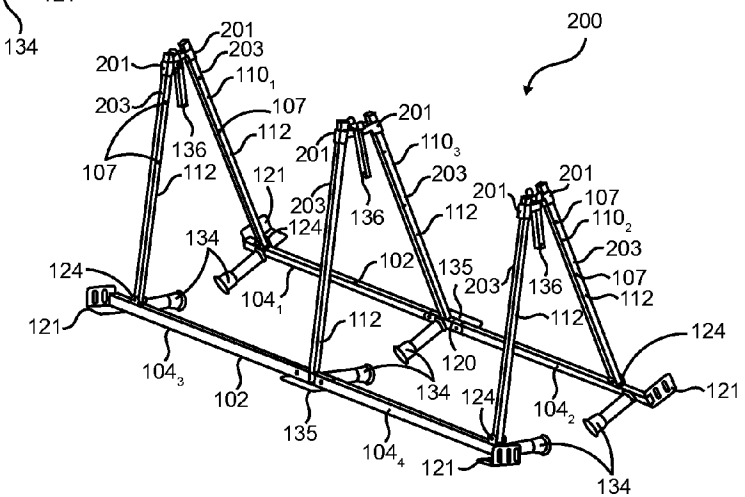
FIG. 5 is a top, left side perspective view illustrating the bed frame of FIG. 4 in a partially collapsed state.

In the preferred embodiment, each outer leg 134 is fixedly attached to lower sides of the free ends of the longitudinal beams 108 and to lower sides of the longitudinal beams 102 between the free ends 108. The outer legs 134 extend downward and are configured for attaching extensions such as wheels (as shown in FIG. 1), glides (stationary extensions), risers (vertically adjustable extensions as shown in FIGS. 4-5) or elongated rectangular hollow extensions such as auxiliary legs 136.

Figure 14:
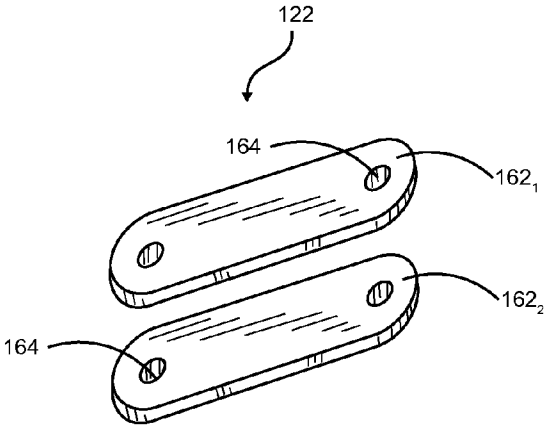
FIG. 14 is a perspective view illustrating a second pivotal coupling member of the present invention.

Each longitudinal beam 102 is formed by a pair of longitudinal bars 104 (e.g., $\mathbf{104}_1$-$\mathbf{104}_4$) having inner ends 106 that are pivotally connected together via a U-shaped first pivotal coupling member 120, and the other ends of each longitudinal bar 104 form the free ends 108 of the longitudinal beams 102. An illustrative first pivotal coupling member 120 is shown and described below with respect to FIG. 13. Alternatively, the longitudinal bar inner ends 106 can be pivotally connected with a second pivotal coupling member 122 which is shown in FIG. 14 and described in more detail below. A groove opening 148 of each first pivotal coupling member 120 (or a space provided between plates 162 of each second pivotal coupling member 122) provides a first plane of motion for the longitudinal bars 104. The first plane of motion is formed along the X-Y plane as shown in FIG. 1, i.e., along the longitudinal axis of the longitudinal beams 102 and extending inwardly approximately 90 degrees towards a transverse bar 112 of the third transverse beam $\mathbf{110}_3$ coupled normally with respect to the longitudinal beams 102.

Figure 13:
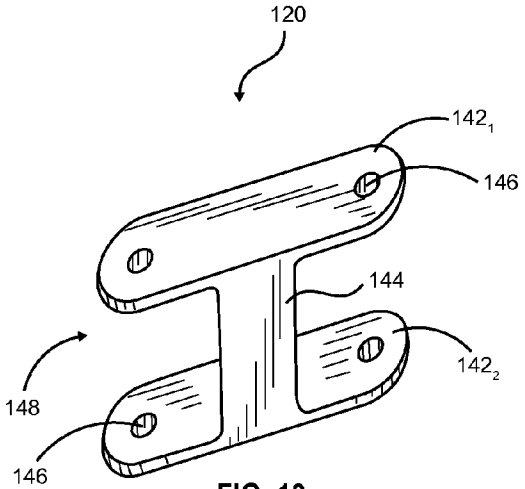
FIG. 13 is a perspective view illustrating a first pivotal coupling member of the present invention.

Referring to FIG. 13, an example of a first pivotal coupling member 120 is illustratively shown. The first pivotal coupling member 120 includes a pair of opposing plates $\mathbf{142}_1$ and $\mathbf{142}_2$ (collectively, "142"), and an intermediate member 144 attached therebetween along a rear edge of the plates 142 to form a U-shaped bracket. The plates 142 are fixedly spaced apart by the intermediate member 144 a distance suitable for receiving the inner ends 106 of the longitudinal bars 104. The two opposing plates 142 are illustratively shown as being oval in shape, however, such shape and configuration is not limiting. For example, the plates 142 can be shaped rectangular. The area between the plates 142 and interior surface of the intermediate member 144 form a groove opening 148 which faces outwardly with respect to the bed frame while in an open state, and which receives the adjacent inner ends 106 of the longitudinal bars 104. A pair of bores 146 are formed proximate each end of the plates $\mathbf{142}_1$ and $\mathbf{142}_2$, and each pair of opposing bores 146 in each plate 142 are aligned to receive a fastener, such as a bolt, rod or other fastener (not shown), to secure the inner ends 106 of the longitudinal bars 104. Specifically, a pair of bolts or rods extend through the pair of axially aligned bores 146 formed in the opposing plates 142, and each bolt or rod extends through a bore (not shown) formed through the top and bottom walls of each inner end 106 of the longitudinal bars 104. The inner ends 106 of the longitudinal bars 104 pivot about the bolts or rods along the first plane of motion to enable the bed fame 100 to be configured in an open or closed arrangement. The outer portion of the intermediate members 144 faces inwardly and are preferably fixedly attached (e.g., welded, snap fit, secured with a fastener) to second ends 116 of the third transverse beam $\mathbf{110}_3$ of the bed frame 100.

Figure 18:
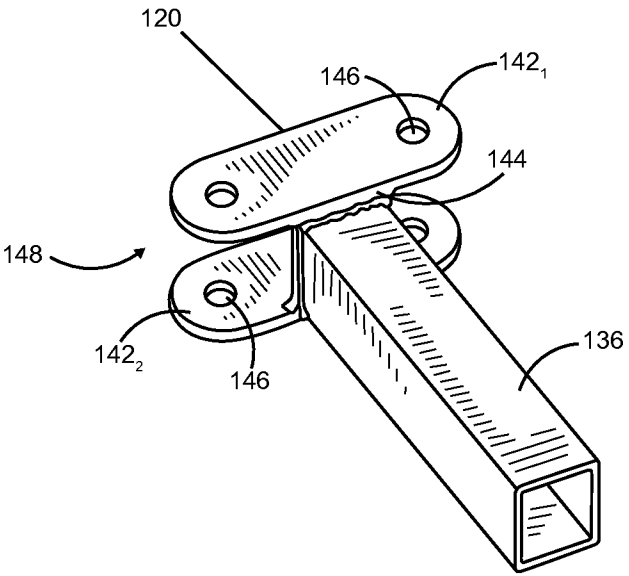
FIG. 18 is a perspective view illustrating a leg assembly fixed to the bottom surface of the first pivotal coupling member.
Figure 17:
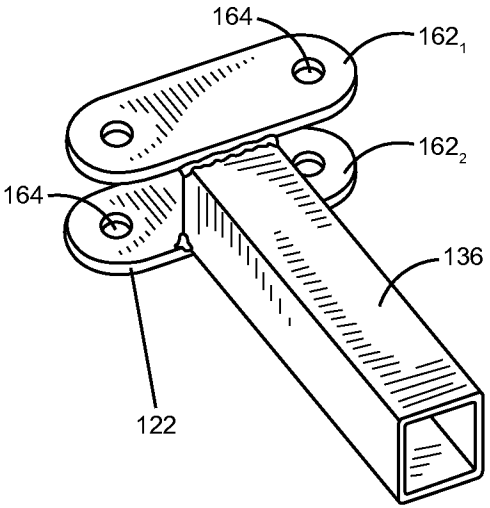
FIG. 17 is a perspective view illustrating a leg assembly fixed to the bottom surface of the second pivotal coupling member.

Similarly, each transverse beam 110 is formed by a pair of transverse bars 112 having first ends 114 pivotally connected together to each side of a U-shaped first pivotal coupling member 120. An auxiliary leg 136 is preferably fixedly attached (e.g., welded, snap fit, secured with a fastener) to each bottom portion of the intermediate members 144 as shown in FIG. 18. Alternatively, the transverse bar first ends 114 of each transverse beam 110 can be pivotally connected with a second pivotal coupling member 122 which includes a pair of plates $\mathbf{162}_1$ and $\mathbf{162}_2$ (collectively "162") and is shown and described below with respect to FIG. 14. In this embodiment, each auxiliary leg 136 is fixedly attached (e.g., welded, snap fit, secured with a fastener) to the opposing plates 162 as shown in FIG. 17. Each auxiliary leg 136 is extended to a length substantially similar to the overall length of the outer legs 134 and its attachments but some or all of the legs 134, 136 could be replaced by other extensions such as wheels, glides (stationary extensions) or risers (vertically adjustable extensions).

Each pair of opposing plates 142, 162 provides a second plane of motion for the transverse bars 112. In this embodiment, the plane of motion is formed along the X-Z plane as shown in FIGS. 1 and 2, i.e., along the longitudinal axis of each transverse bar 112 and extending down and inwardly approximately 90 degrees from each transverse bar 112.

Referring to FIG. 14, an example of a second pivotal coupling member 122 is illustratively shown. The second pivotal coupling member 122 includes a pair of opposing plates $\mathbf{162}_1$ and $\mathbf{162}_2$. The plates 162 are illustratively shown as being substantially oval in shape, however, such shape and configuration is not limiting. For example, the plates 162 can be shaped rectangular. A pair of bores 164 are formed proximate each end of the plates $\mathbf{162}_1$ and $\mathbf{162}_2$, and opposing bores 164 in each plate 162 are aligned to receive a fastener, such as a bolt, rod or other fastener (not shown) to secure the opposing sides of the first (inner) ends 114 of the transverse bars 112. The bolt or rod extends through the both plates 162 and the sides of the transverse bars 112 sandwiched therebetween. The first ends 114 of the transverse bars 112 pivot about the bolts or rods along the second plane of motion (X-Z plane) to enable the bed frame 100 to be configured in an open or closed arrangement.

With further respect to the first and second transverse beams $\mathbf{110}_1$ and $\mathbf{110}_2$, the second opposing ends 116 of each transverse bar 112 are pivotally attached to a side portion of one of the pairs of longitudinal beams 102. In particular, each second end 116 of the first and second transverse beams $\mathbf{110}_1$ and $\mathbf{110}_2$ is pivotally coupled to the free ends 108 of the longitudinal bars 104 by a third pivotal coupling member 118. The third pivotal coupling members 118 are respectively provided along the inner sides of the longitudinal bars 104 proximate the free ends 108, such that an opening 160 of the third pivotal coupling members 118 face inwardly towards each other at the opposing free ends 108 of the longitudinal bars 104. An illustrative third pivotal coupling member 118 is shown and described below with respect to FIG. 15. Alternatively, referring to FIGS. 1 and 16, a fourth pivotal coupling member 124 (described in more detail below) is preferably provided as the means for pivotally coupling the first and second transverse beams 110 to the longitudinal beams 102. The open portion 160 of the third pivotal coupling member 118 (or the open portion between opposing plates $\mathbf{172}_1$ and $\mathbf{172}_2$ of the fourth pivotal coupling members) provides a third plane of motion for the transverse bars 112 of the two transverse beams $\mathbf{110}_1$ and $\mathbf{110}_2$. A third plane of motion is formed along the X-Y plane as shown in FIG. 1, i.e., along the longitudinal axis of the transverse beams 112 and extends inwardly approximately 90 degrees to the longitudinal bars 104.

Figure 15:
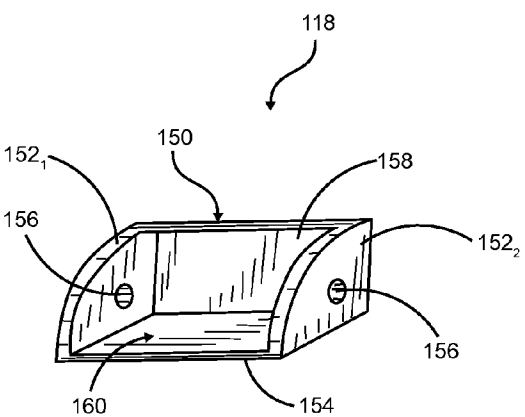
FIG. 15 is a perspective view illustrating a third pivotal coupling member of the present invention.

Referring to FIG. 15, an example of a third pivotal coupling member 118 is illustratively shown. The third pivotal coupling member 118 includes an L-shaped bracket member 150 having a first member 154 affixed substantially orthogonal to a second member 158. First and second side plates $\mathbf{152}_1$ and $\mathbf{152}_2$ (collectively, "152") are affixed to the opposing sides of the L-shaped bracket 150. The side plates 152 can be configured in a quarter-round circular shape and include axially aligned bores 156 dimensioned to receive a bolt, rod or other fastener (not shown). The shape of the side plates 152 is not considered limiting as a rectangular or other curvilinear shape is contemplated. The L-shaped bracket 150 includes an open portion 160 which is dimensioned to receive the second ends 116 of each transverse bar 112 of the first and second transverse beams $\mathbf{110}_1$, $\mathbf{110}_2$. A bolt, rod or other fastener (not shown) extends through the pair of axially aligned bores 156 formed in the opposing plates 152 and the bolt or rod further extends through aligned bores (not shown) formed through the top and bottom walls at the transverse bar second ends 116 of the first and second transverse beams $\mathbf{110}_1$, $\mathbf{110}_2$. The second ends 116 of the transverse bars 112 pivot about the bolt or rod (i.e., axle) along the third plane of motion (X-Y plane) to enable the bed frame 100 to be configured in an open or closed arrangement. The rear portion of the first member 154 or second member 158 of each third pivotal coupling member 118 is fixedly attached to a corresponding inner side surface of the longitudinal bar 104 at the free end 108, such that the opening 160 of each third pivotal coupling member 118 faces inward towards an opening 160 of an opposing third pivotal coupling member 118. The first member 154 or second member 158 is preferably fixedly attached to the inner side surface of the longitudinal bar 104 by welding, snap fit, secured with a fastener, among other well-known fastening techniques. While closing the bed frame 100, each third pivotal coupling member 118 enables a corresponding transverse bar 112 to rotate approximately ninety (90) degrees inwardly with respect to the longitudinal bars 104.

Specifically, with respect to the two transverse beams $\mathbf{110}_1$ and $\mathbf{110}_2$ located at a front end and a rear end of the bed frame 100, each respective transverse bar 112 is collapsible towards the central portion of the bed frame 100 with respect to the corresponding longitudinal beam 102, as illustratively shown in FIGS. 2 and 3. The direction of rotation of the transverse bars 112 with respect to the longitudinal bars 104 is restricted by the positioning of the opening 160 of the third pivotal coupling member 118, i.e., to permit rotation or folding of the transverse bars 110 only along the longitudinal axis of the longitudinal bars 104.

Figure 16:
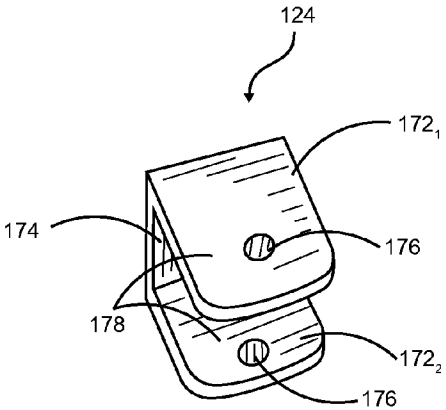
FIG. 16 is a perspective view illustrating a fourth pivotal coupling member of the present invention.

Referring to FIGS. 1, 2 and 16, a fourth pivotal coupling member 124 is preferably used in place of the third pivotal coupling member 118. The fourth pivotal coupling member 124 includes a pair of L-shaped plates $\mathbf{172}_1$ and $\mathbf{172}_2$ (collectively, "172") and an intermediate member 174 attached therebetween along a rear edge of the plates 172. The plates 172 are fixedly spaced apart by the intermediate member 174 a distance suitable for receiving the second ends of the transverse bars 116. The transverse bars 112 also provide a plane of motion along the X-Y plane as shown in FIG. 1 (i.e., the third plane of motion), along the longitudinal axis of the transverse bars 112 and extends inwardly 90 degrees to the longitudinal beams 102. An outer surface of the intermediate member 174 is preferably fixedly attached (e.g., welded, snap fit, secured with a fastener) to the second ends of the longitudinal bars 108 at an inner side wall. A pair of bores 176 are formed on the plates $\mathbf{172}_1$ and $\mathbf{172}_2$, and the opposing bores in each plate 176 are aligned to receive a fastener, such as a bolt or rod (not shown) to pivotally secure the transverse bar second ends 112.

Referring to FIGS. 1 and 2, each transverse bar 112 is formed by a first sliding member 101 that is a substantially rectangular hollow shaft slidable within a second sliding member 103 that is a substantially rectangular hollow sleeve. The outer dimensions of the shaft 101 are substantially similar to the inner dimensions of the sleeve 103 such that the shaft 101 is telescoped within the sleeve 103. The shaft 101 includes a locking aperture 105 for receiving a locking member 107 in the form of a biased locking pin which is stored within the shaft 101. The sleeve 103 includes a plurality positioning apertures 109 at predetermined position points, each sleeve aperture 109 corresponding to a separate predetermined relative position or bed frame width. Each sleeve aperture 109 can be labeled with the appropriate predetermined position (e.g., twin, full, queen, king, etc.) so that a user can conveniently adjust the width of the bed frame to a desired position. The length of the locking pin 107 is such that the locking pin 107 extends through the apertures 105, 109 beyond the outer surface of the sleeve 103. A desired predetermined position is attained by aligning and engaging the locking pin 107 and a sleeve aperture 109 corresponding to the desired predetermined position.

Figure 9:
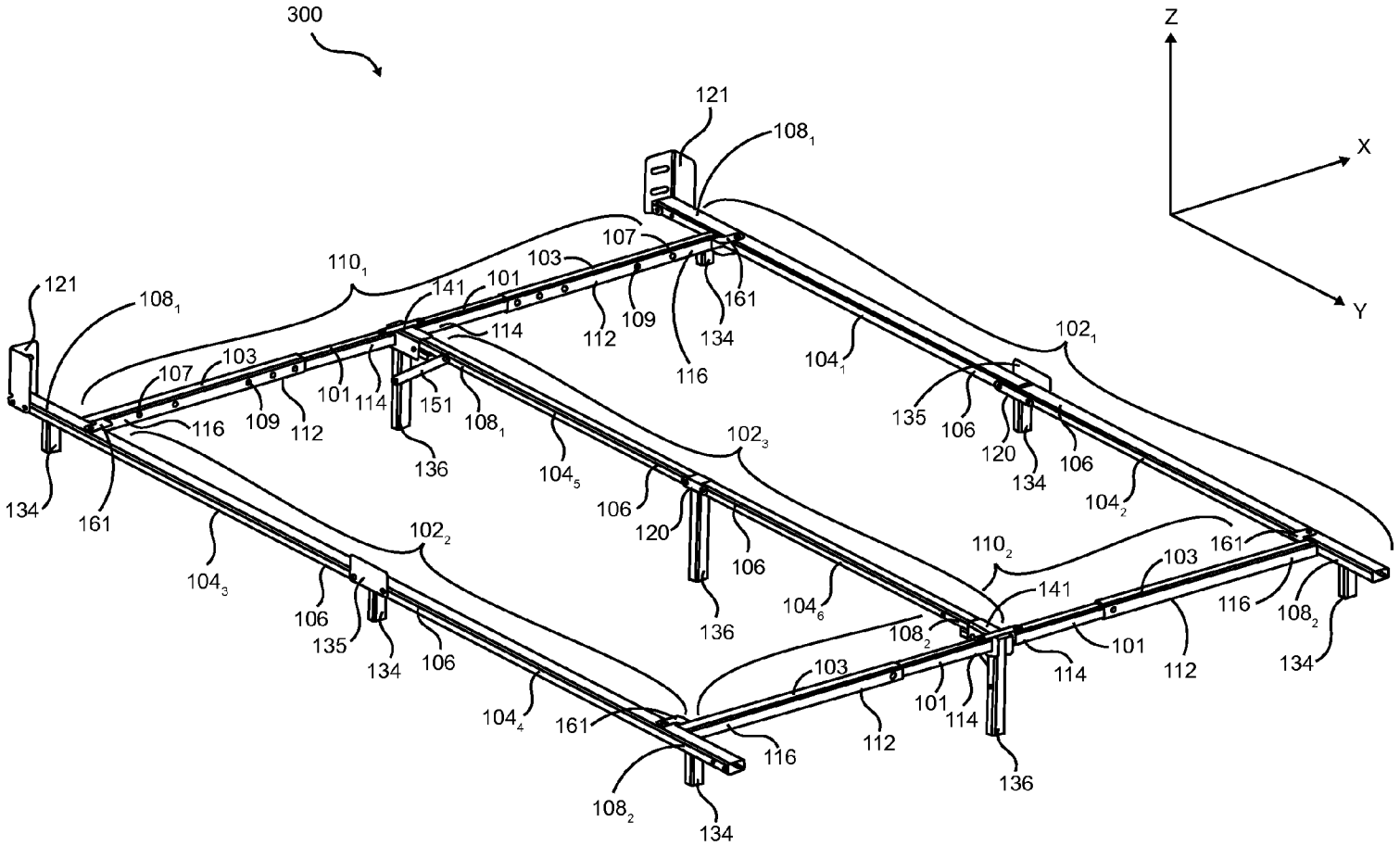
FIG. 9 is a top perspective view illustrating a third embodiment of an adjustable folding bed frame of the present invention in a completely expanded state.

Referring to FIGS. 1 and 2, each transverse bar 112 further includes a cap 111 which is attached to each shaft 101 distal end 114 or 116 (except for the distal end 116 of one of the shafts 101 of the third transverse beam $\mathbf{110}_3$, which is fixedly connected to the longitudinal beam 102 via the first pivotal coupling member 120). The outer dimensions of the cap 111 are substantially identical to the sleeve 103 outer dimensions. The cap 111 is utilized to allow the transverse beams 110 to be uniformly manufactured without altering the sizes of the pivotal coupling members 120, 124. The cap 111 includes opposing apertures 113 corresponding to apertures located at the distal ends of the shaft 115 such that a fastener 117 extends through the apertures as well as the pivotal coupling members 120 and 124. Specifically, for the pivotal connections with the first pivotal coupling member 120, each bolt, rod or other fastener 117 extends through the axially aligned bores 146; the apertures formed through the opposing side walls of the shaft end 115; and the aligned apertures of the cap 113. Similarly, for pivotal connections with the fourth pivotal coupling member 124, each bolt, rod or other fastener (not shown) extends through the axially aligned bores 176; the bores (not shown) formed through the opposing side walls of the shaft end 116; and the aligned apertures (not shown) of the cap 111. One of ordinary skill in the art will recognize that other variations could replace the cap 111 such as washers and the like. The orientation of each transverse bar 112 could also vary. For example, even though in this embodiment the shaft portion 101 of one transverse bar 112 is coupled to a center portion of the bed frame and another the shaft portion 101 of another transverse bar 112 is coupled to an outer portion of the bed frame (as shown in FIG. 1), both shaft portions 101 could be coupled to a center portion of the bed frame as shown in FIG. 9.

Referring to FIG. 1, the bed frame 100 further preferably includes a pair of L-shaped end flanges 121 each formed by an adjoining back plate 123 and a side plate 125. The back plate 123 has slots 127 for attaching the bed frame 100 to a headboard (not shown), and further includes an extension 129 (see, e.g., FIG. 24) extending normal from the back plate 123 and parallel to the side plate 125. Each end flange 121 is positioned at the outermost end of each longitudinal beam first end $\mathbf{108}_1$ to prevent a box spring or mattress (not shown) from shifting longitudinally past the end flanges 121. Each end flange 121 extends upward and is pivotally connected to each longitudinal beam first end $\mathbf{108}_1$ with a fastener (not shown) which extends through the side plate 125 and the extension 129 such that the end flanges 121 pivot inward ninety degrees when the bed frame 100 is folded (see, e.g., FIG. 3).

Figure 25:
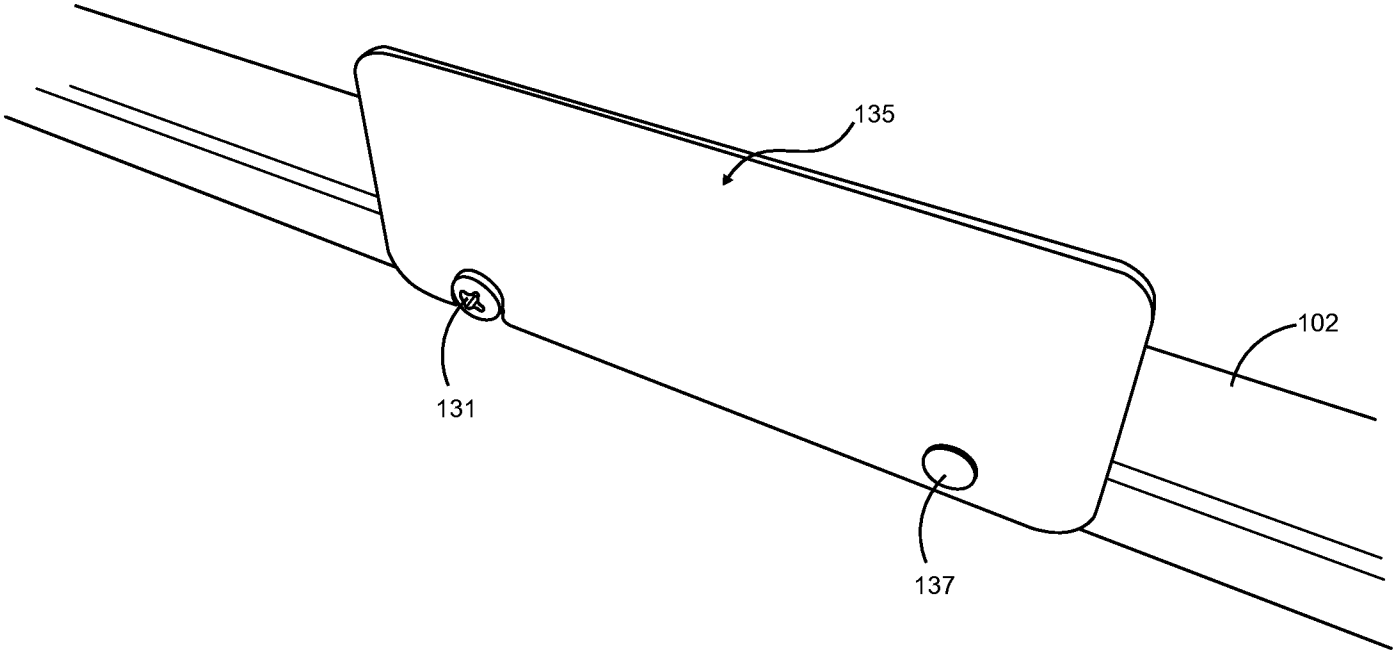
FIG. 25 is a perspective view of a side flange of the present invention in an engaged state.
Figure 26:
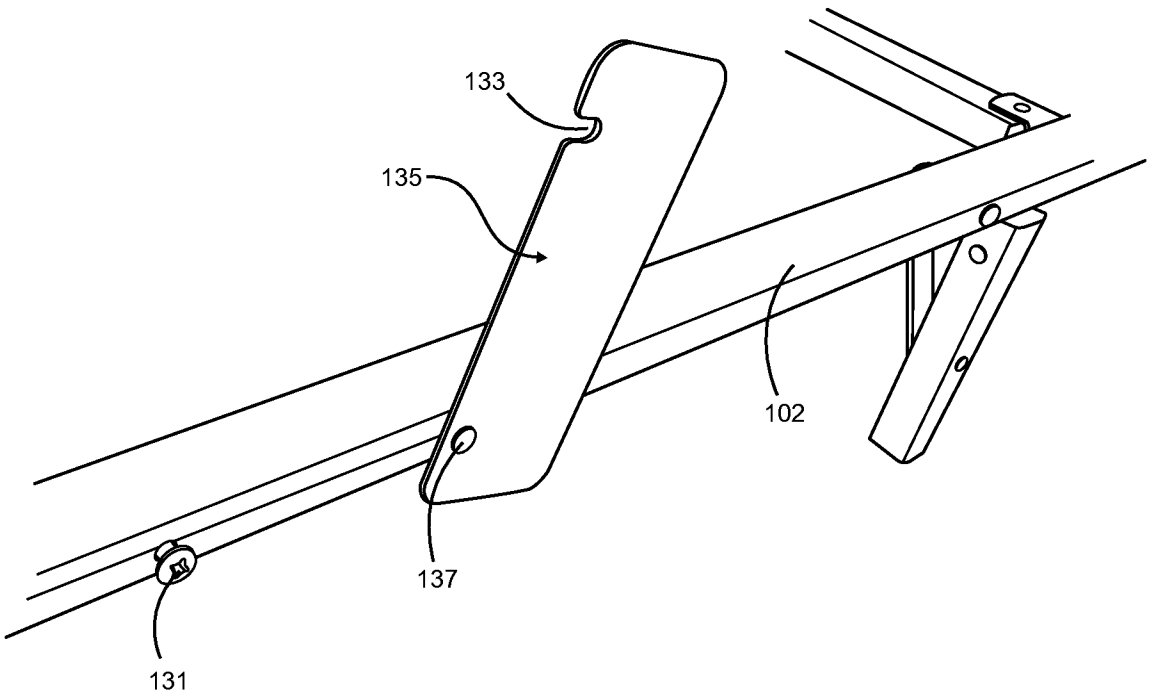
FIG. 26 is a perspective view of the side flange of FIG. 25 in a disengaged state.

The bed frame 100 also includes a pair of side flanges 135 extending upward from an outer side of each longitudinal beam 102 between the free ends 108 at a center portion of the bed frame 100 as shown in FIGS. 1 and 2. However, the side flanges 135 could be positioned at other locations of the longitudinal beam 102. Each side flange 135 is preferably rectangular but any other shapes could be used without departing from the spirit and scope of the present invention. The side flanges 135 prevent the box spring or mattress (not shown) from shifting laterally beyond the outer edges of the longitudinal beams 102. The side flanges 135 are pivotally connected to the longitudinal beams by a fastener or the like 137 so that when pivoted 180 degrees, the side flanges 135 extend downward, as shown, for example, in FIG. 3. Referring to FIGS. 25 and 26, an outer side of the longitudinal beam 102 includes a locking extension 131 extending therefrom, preferably a fastener or the like. Each side flange 135 includes an indentation 133 for securely engaging the locking extension 131 when the side flange 135 is in use. The indentation 133 is disengaged from the locking extension 131 when the side flange 135 is not in use or when the bed frame 100 is folded. Such a configuration provides a more compact bed frame 100 in the folded state as shown in FIG. 3. One of ordinary skill in the art will recognize that the bed frame of the present invention could be used without end flanges or side flanges to support other types of mattresses (e.g., air mattresses) that may not conform with the exact dimensions of the bed frame.

FIGS. 2-3 illustrate the folding process of the bed frame 100 of FIG. 1. The general steps for folding the bed frame 100 are substantially similar to the folding steps of the bed frame of the second embodiment of the present invention (shown in FIGS. 4-8). The wheels are first detached from the legs 134 of the longitudinal beams 102, and the end flanges 121 and the side flanges 135 are pivoted inward and downward, respectively.

Referring to FIG. 2, the paired second ends 116 of two transverse bars 112 forming each of the three transverse beams 110 are rotated downward inwardly about the first pivotal coupling member 120 until the two longitudinal beams 102 are arranged parallel and adjacent to each other, and each pair of transverse bars 112 extend upward and are arranged parallel and adjacent to each other such that each pair of transverse bars 112 are positioned substantially orthogonal with respect to the longitudinal beams 102. In this manner, the first ends 114 of the transverse bars 112 are rotated about their corresponding pivot points (e.g., bolts or rods 117) on the first pivotal coupling members 120.

Figure 2A:
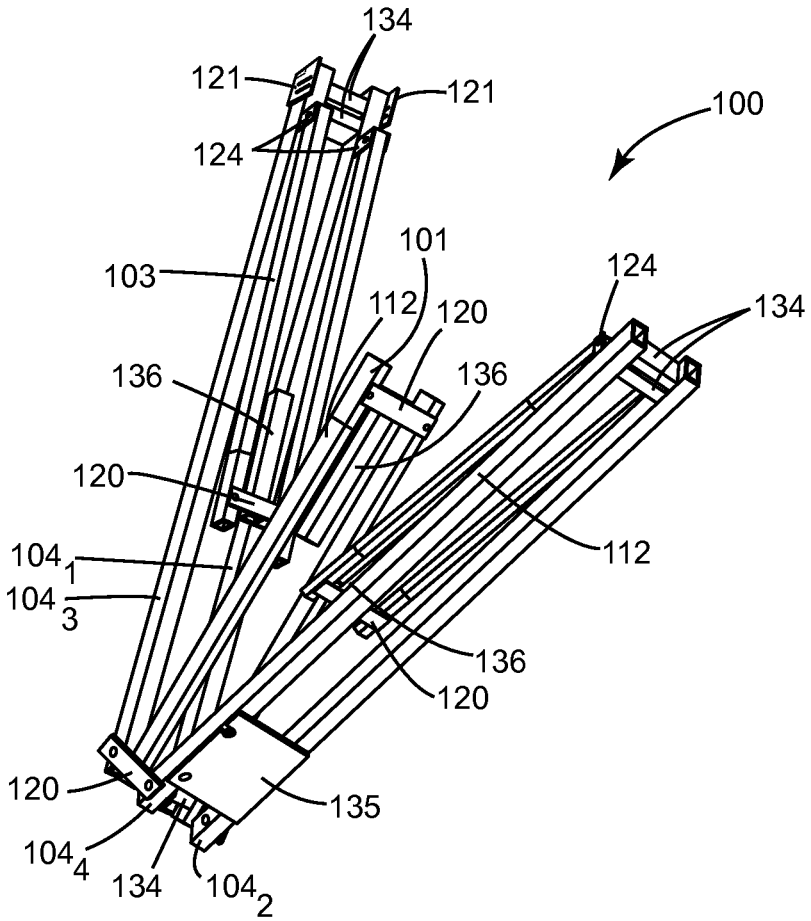
FIG. 2A is a perspective view illustrating the bed frame of FIG. 1 in another partially collapsed state.

Referring to FIG. 2A, the transverse bars 112 at two ends of each longitudinal beam 102 (i.e., transverse beams $\mathbf{110}_1$ and $\mathbf{110}_2$) are rotated inward about the bolt or rod of the fourth pivotal coupling member 124 (i.e., folded along the longitudinal axis of the longitudinal beams 102) and positioned towards the inner sides of the corresponding longitudinal bars 104. In this manner, the transverse bars 112 at two ends of each longitudinal beam 102 are positioned parallel to the respective adjacent longitudinal bars 104. That is, on one side, the folded first transverse beam $\mathbf{110}_1$ and longitudinal bars $\mathbf{104}_1$ and $\mathbf{104}_3$ are grouped together substantially parallel and adjacent to each other. On an opposite side, the folded second transverse beam $\mathbf{110}_2$ and longitudinal bars $\mathbf{104}_2$ and $\mathbf{104}_4$ are grouped together substantially parallel and adjacent to each other. During this time, the folded third transverse beam $\mathbf{110}_3$ extends upward from and substantially perpendicular to the longitudinal beams 102.

The free ends $\mathbf{108}_1$ and $\mathbf{108}_2$ of the two longitudinal bars 104 of each longitudinal beam 102 and each folded first and second transverse beams $\mathbf{110}_1$ and $\mathbf{110}_2$, respectively, are raised upward towards each other and toward the upright folded third transverse beam $\mathbf{110}_3$ by rotating the longitudinal bars 104 about the corresponding pivot points provided by the first pivotal coupling member 120 connecting the inner ends of the longitudinal bars 106, as shown in FIG. 2A. The longitudinal bars 104 are rotated until they are positioned together in at least a substantially parallel arrangement, as shown in FIG. 3. Accordingly, the longitudinal bars 104 and the transverse bars 112 of the bed frame 100 are collectively folded together in a parallel arrangement to significantly reduce the overall footprint of the bed frame 100, thereby making it easier to transport and store.

A person of ordinary skill in the art will appreciate that the bed frame 100 can be opened fully by reversing the folding actions set forth and described above. As described above, the width of the bed frame 100 can be adjusted by disengaging the locking pin 107 of each transverse bar 112; shifting the shaft and sleeve 101, 103 of each transverse bar 112; and engaging the locking pin 107 with a sleeve aperture 109 corresponding to a desired predetermined position. The process of adjusting the bed frame width is simplified when performing while the bed frame 100 is in the partially folded position shown in FIG. 2 due to the closer proximity of the locking pins 107 of each pair of transverse bars 112. It is also advantageous to adjust the bed frame 100 while in the partially folded position because the geometric constraints are minimized compared to adjusting the bed frame 100 in a fully opened configuration as shown in FIG. 1.

Second Embodiment

Referring to FIGS. 4-8, a second embodiment of an adjustable folding bed frame 200 of the present invention is shown. The general opening and folding functions of the bed frame of the second embodiment 200 are identical to the bed frame of the first embodiment 100, i.e., the three planes of motion are the same. However, the method of adjusting the width of the bed frame 200, the structural components of the transverse bars 112 and the pivotal coupling member connecting the transverse bars 112 of each transverse beam 110 differ and will be described in more detail below. The structural components and functions of the bed frame of the second embodiment 200 that are identical to the bed frame of the first embodiment 100 are described above in the description of the first embodiment and is incorporated by reference in this section.

Figure 6:
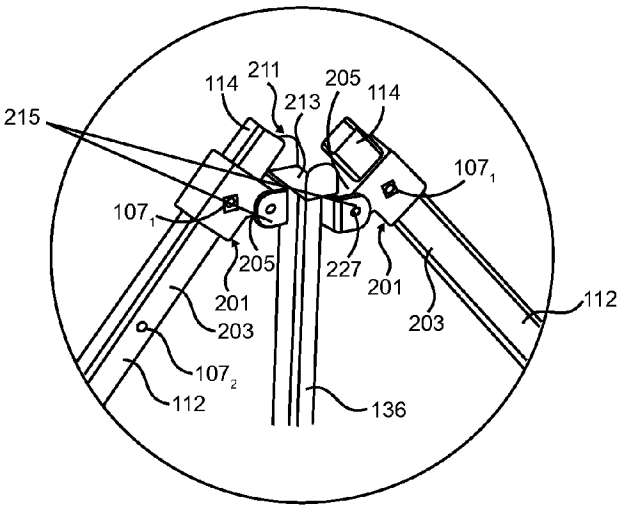
FIG. 6 is a partial side perspective view illustrating opposing transverse bars pivotally coupled by a fifth pivotal coupling member of the bed frame of FIG. 4 which is also shown in more detail in FIG. 19.

Referring to FIG. 6, the transverse bars 112 of each transverse beam 110 include first and second sliding members 203, 201, respectively. The second sliding member 201 is a substantially square hollow sleeve having a locking aperture on a side wall. The sleeve 201 includes an extension 205 extending normal from a bottom portion which is provided with a bore (not shown) extending axially through the extension 205 substantially parallel to the locking aperture of the sleeve 201.

Referring to FIGS. 5 and 6, the first sliding member 203 is a substantially square and hollow shaft extending the length of the entire transverse bar 112. The outer dimensions of the shaft 203 are equal to or slightly less than the inner dimensions of the sleeve 201 such that the shaft 203 is slidable within the sleeve 201. In this embodiment, the sliding members 201, 203 are metal and hollow to reduce the weight of the bed frame 200 while maintaining strength. One of ordinary skill in the art will recognize that the material and shape of the sliding members 201, 203 could vary without departing from the spirit and scope of the invention.

Figure 7:
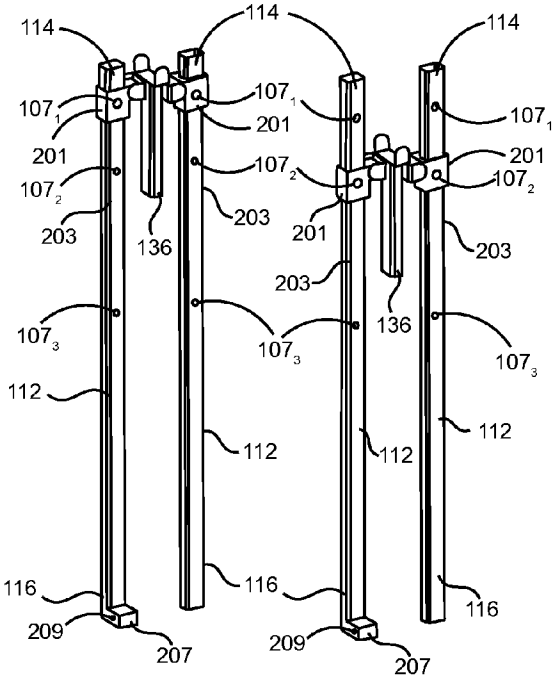
FIG. 7 is a partial side perspective view illustrating opposing transverse bars of the bed frame of FIG. 4 in two different predetermined positions.

Referring to FIG. 7, the shaft 203 includes a plurality of positioning apertures at predetermined position points, each positioning aperture corresponding to a separate predetermined relative position or bed frame width. A plurality of locking members $\mathbf{107}_1$, $\mathbf{107}_2$, $\mathbf{107}_3$ in the form of biased locking pins (collectively, locking pins 107) are stored within the shaft 203 and extend through each shaft aperture. Thus, the locking aperture of the sleeve 201 is engaged with a locking pin 107 corresponding to a desired predetermined width of the bed frame 200. The width of the bed frame 200 is further adjusted to a different desired position by depressing the locking pin 107 to disengage from the locking aperture of the sleeve 201 and sliding the sleeve 201 until a locking pin 107 corresponding to a desired position is engaged with the locking aperture of the shaft 201 as shown, for example, in FIG. 4. One of ordinary skill in the art will recognize that any number of apertures can be formed on the shaft 203 to correspond to any number of bed sizes. Referring to FIG. 7, in this embodiment, the apertures of each opposing shaft 203 corresponding to a predetermined position are equidistant from the first ends 114 of each opposing shaft 203 (i.e., a mirror image). A second end of one transverse bar of each transverse beam 116 (shaft portion 203) includes an extension 207 extending normal to the remaining transverse bar 112 and includes apertures 209 extending through the extension 207 for pivotally connecting to the fourth coupling member 124 (FIG. 16) at a free end of a corresponding longitudinal beam 108 as shown in FIG. 5. Given the side-by-side arrangement of the shafts 203 of each transverse beam 112 (described in more detail below), the extension 207 is provided so that the pivotal connections of the second ends of each transverse bar 116 are aligned transversely. This also allows the longitudinal beams 102 to be uniformly manufactured without changing locations of the fourth pivotal coupling members 124.

Figure 19:
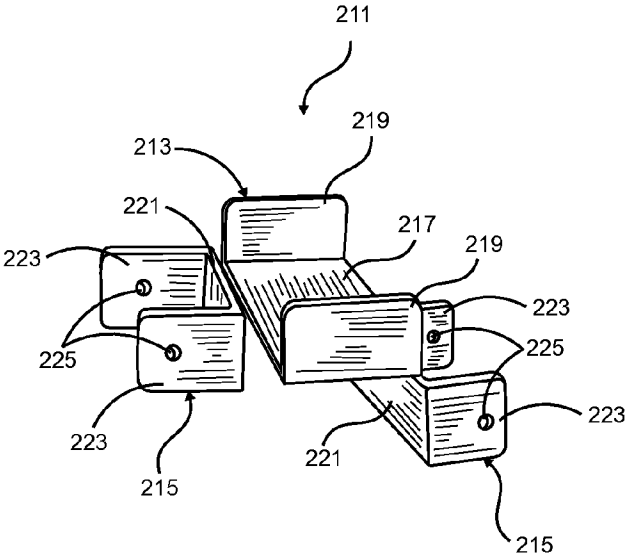
FIG. 19 is a top perspective view illustrating a fifth pivotal coupling member of the present invention.

Referring to FIGS. 6 and 19, the transverse bars 112 of each transverse beam 110 are pivotally connected to each other by a fifth pivotal coupling member 211. Referring to FIG. 19, the fifth pivotal coupling member 211 comprises three U-shaped members. The first U-shaped member is a U-shaped base 213 with a pair of U-shaped extensions 215 each extending laterally from a lower side of opposing lateral sides of the U-shaped base 213. The U-shaped base 213 includes a bottom plate 217 having opposing longitudinal ends and opposing lateral ends, and a pair of opposing side plates 219 each extending upwardly from opposing longitudinal ends. The bottom plate 217 has a width (measured from one longitudinal end to an opposing longitudinal end) substantially equal to the combined width of the two opposing transverse bar shafts 203 and provides a support surface for the shafts 203 when the bed frame 200 is in the open configuration as shown in FIG. 4. Each U-shaped extension 215 (or second and third U-shaped members) includes a base plate 221 having longitudinal and lateral ends, and a pair of laterally extending opposing side plates 223 having aligned apertures 225. The inner side plates 223 of the opposing U-shaped extensions 215 are substantially aligned along a central lateral axis of the U-shaped base 213. Referring to FIG. 6, a fastener 227 (such as a bolt, screw or rod) extends through the aligned sleeve apertures (not shown) and corresponding side extension apertures 225 to provide a pivotal connection for each transverse bar 112. An auxiliary leg 136 is further fixed (welded, snap fit, or secured with a fastener) to the bottom portion of fifth pivotal coupling member 211 (as shown, for example, in FIG. 18) to provide additional support to the interior portions of the bed frame 200.

The structural configuration of the sleeve and shaft 201, 203 as well as the fifth pivotal coupling member 211 provide the bed frame 200 with further advantages in the width adjustment process. Referring to FIG. 7, when the bed frame 200 is in a partially folded configuration, the width of each transverse beam 110 can be easily adjusted without any geometrical constraints and without affecting the remaining bed frame 200 because the opposing apertures and locking pins $\mathbf{107}_1$, $\mathbf{107}_2$, $\mathbf{107}_3$ corresponding to each specific predetermined position are aligned laterally. Therefore, adjusting the width of the bed frame 200 simply requires the user to depress each opposing locking pin 107 and sliding the sleeve 201 to a desired new pair of locking pins 107.

Referring to FIGS. 4 and 5, end flanges 121 and side flanges 135 are pivotally coupled to each free end 108 and midpoint of each longitudinal beam 102, respectively, as described in the first embodiment above, but one with ordinary skill in the art will recognize that less than four end flanges 121 could be used without departing from the spirit and scope of the invention.

Figure 8:
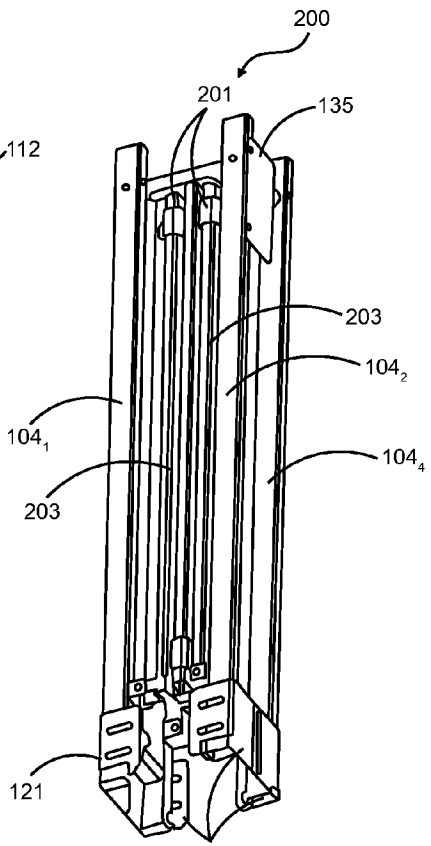
FIG. 8 is a perspective view illustrating the bed frame of FIG. 4 in a fully collapsed state.

The bed frame 200 is folded from a fully opened configuration as shown in FIG. 4 to a fully folded configuration as shown in FIG. 8 in a similar manner as described above in the description of the bed frame of the first embodiment 100. That is, the leg extensions are detached from the outer legs 134; from the open configuration shown in FIG. 4, the transverse bars 112 are rotated down and inward about the fifth pivotal coupling member 211 along the X-Z plane (the second plane of motion) as shown in FIG. 5; from the partially folded configuration shown in FIG. 5, the folded outer transverse beams $\mathbf{110}_1$ and $\mathbf{110}_2$ are rotated inward about the fourth pivotal coupling members 124 toward corresponding longitudinal bars 104 along the Y-Z plane; and the longitudinal bars 104 and folded outer transverse beams $\mathbf{110}_1$ and $\mathbf{110}_2$ are rotated inward about the first pivotal coupling members 120 toward the folded third transverse beam $\mathbf{110}_3$ along the Y-Z plane as shown in FIG. 8.

Third Embodiment

Figure 10:
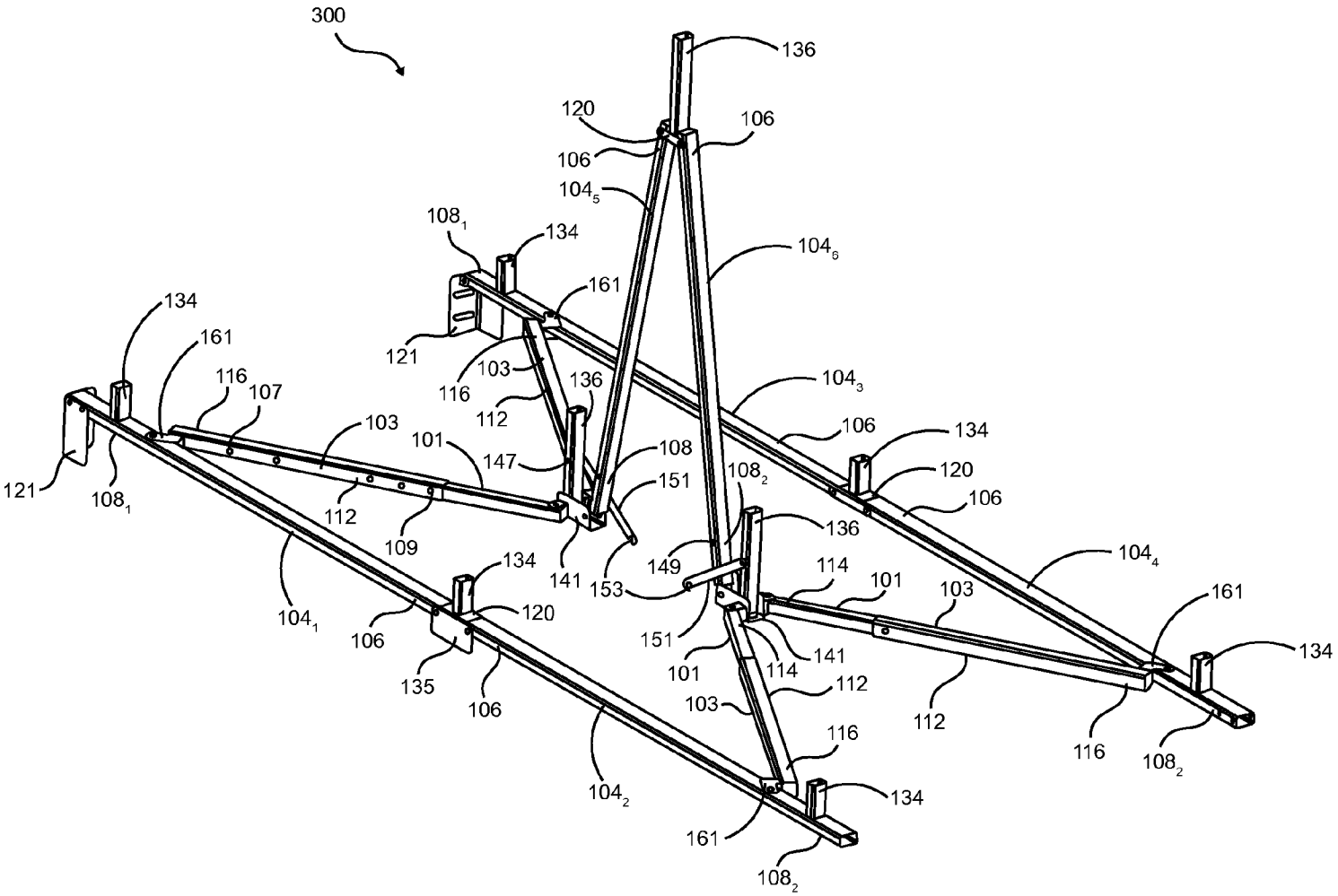
FIG. 10 is a bottom perspective view illustrating a first collapsing operation of the bed frame of FIG. 9.
Figure 11:
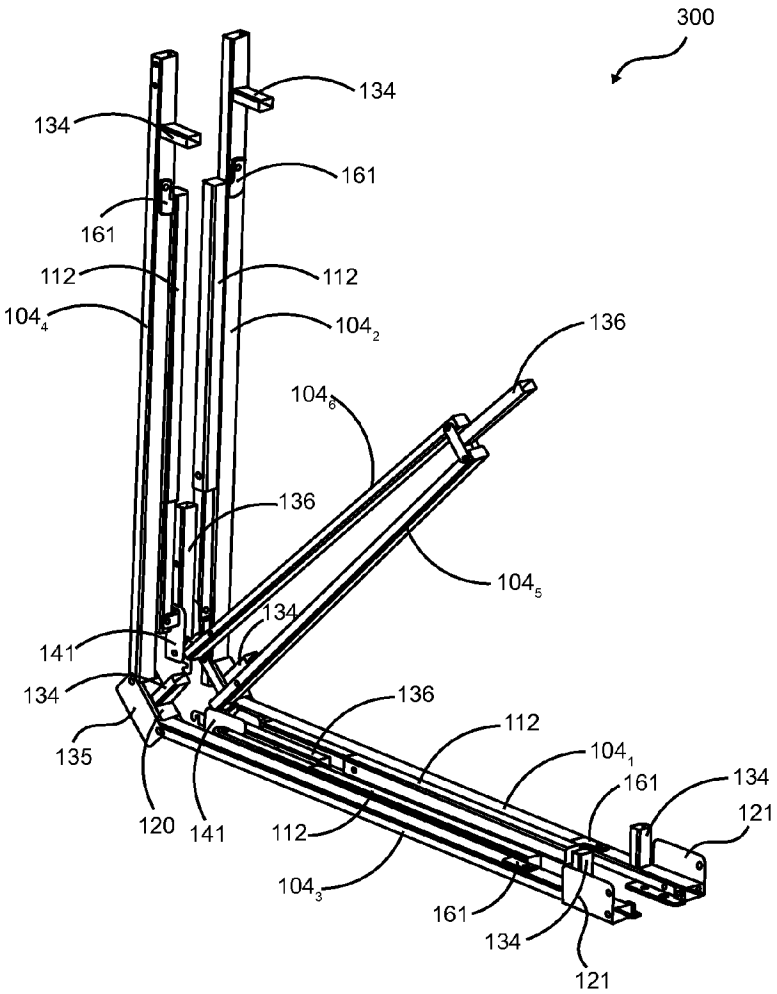
FIG. 11 is a bottom perspective view illustrating a second collapsing operation of the bed frame of FIG. 9.
Figure 12:
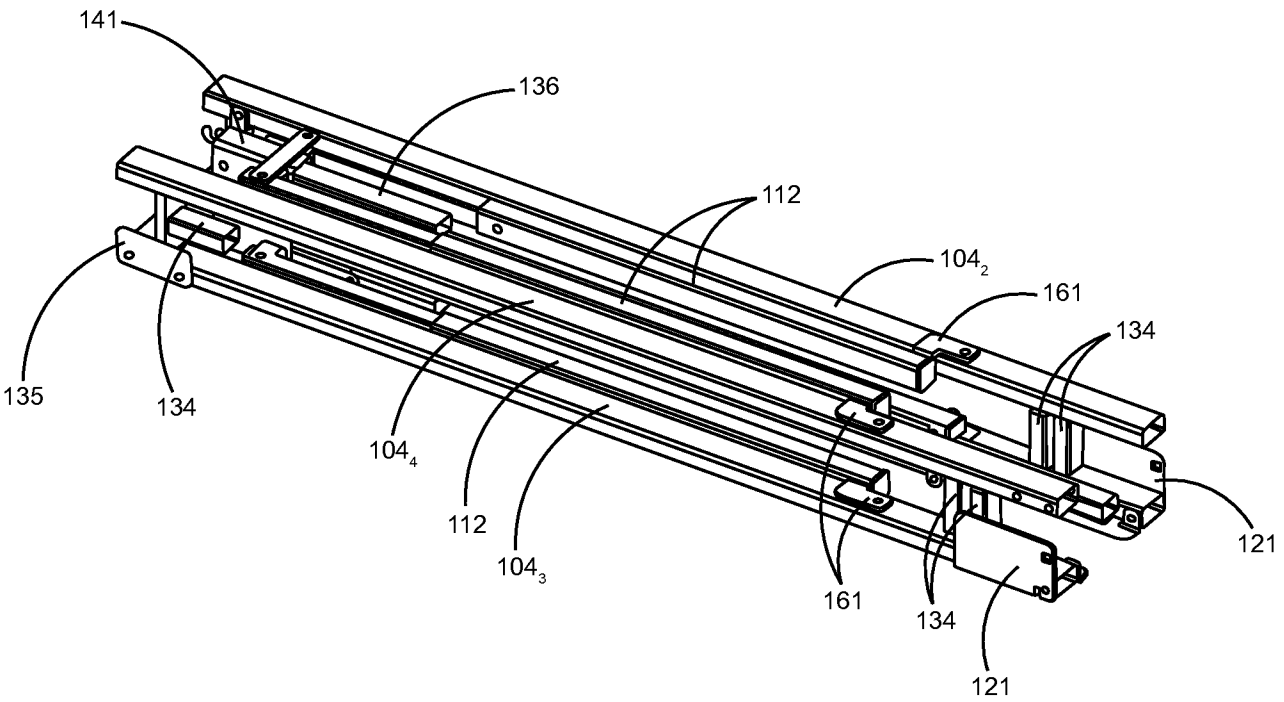
FIG. 12 is a perspective view illustrating the bed frame of FIG. 9 in a fully collapsed state.

Referring to FIGS. 9-12, an adjustable folding bed frame of the third embodiment 300 of the present invention is illustratively shown. FIG. 9 illustrates the bed frame 300 in a fully open configuration and FIGS. 10-12 illustrate how the bed frame 300 can be easily folded into a significantly reduced size for convenient transport and/or storage. The bed frame 300 comprises three longitudinal beams $\mathbf{102}_1$, $\mathbf{102}_2$, $\mathbf{102}_3$ (collectively, 102) two transverse beams $\mathbf{110}_1$, $\mathbf{110}_2$ (collectively, 110) and at least four legs 134, 136 (e.g., nine legs shown). The beams and legs 102, 110, 134, 136 are formed with metal and are of rectangular hollow shape to reduce weight while maintaining strength, but one of ordinary skill in the art will recognize that other materials and shapes could be used without departing from the spirit and scope of the invention.

As illustratively shown in its open configuration of FIG. 9, the two transverse beams 110 are spaced apart and each end 116 is coupled normal to the outer longitudinal beams 102 to form a substantially rectangular bed frame 300. Specifically a first transverse beam $\mathbf{110}_1$ is coupled between opposing first ends (i.e., free ends $\mathbf{108}_1$) of the outer longitudinal beams $\mathbf{102}_1$, $\mathbf{102}_2$, and a second transverse beam $\mathbf{110}_2$ is coupled between opposing second ends (i.e., free ends $\mathbf{108}_2$) of the outer longitudinal beams $\mathbf{102}_1$, $\mathbf{102}_2$. Preferably, a third longitudinal beam $\mathbf{102}_3$ is coupled to the transverse beams 110 centrally between outer ends of each transverse beam 116.

In the preferred embodiment, each outer leg 134 is fixedly attached to lower sides of the free ends 108 of the outer longitudinal beams $\mathbf{102}_1$, $\mathbf{102}_2$ and to lower sides of the outer longitudinal beams $\mathbf{102}_1$, $\mathbf{102}_2$ between the free ends 108 of each outer longitudinal beam $\mathbf{102}_1$, $\mathbf{102}_2$. The outer legs 134 extend downward and are configured for attaching extensions such as wheels (as shown in FIG. 1), glides (stationary extensions), risers (vertically adjustable extensions as shown in FIGS. 4-5) or a continuous rectangular hollow extension such as the auxiliary legs 136.

Each longitudinal beam 102 is formed by a pair of longitudinal bars 104 (e.g., $\mathbf{104}_1$-$\mathbf{104}_6$) having inner ends 106 that are pivotally connected together via the U-shaped first pivotal coupling member 120. An illustrative first pivotal coupling member 120 is shown and described above with respect to FIG. 13. Alternatively, the longitudinal bar inner ends 106 can be pivotally connected with the second pivotal coupling member 122 which is shown in FIG. 14 and described in more detail above. The groove opening 148 of each first pivotal coupling member 120 (or the space provided between plates 162 of each second pivotal coupling member 122) provides two separate planes of motion for the longitudinal bars 104 as shown in FIGS. 9-11. Specifically, with respect to the outer longitudinal bars $\mathbf{104}_{1\text{-}4}$, the plane extends along the longitudinal axis of each longitudinal bar $\mathbf{104}_{1\text{-}4}$ from the first pivotal coupling member 120 and extends down and inward approximately 90 degrees along the Y-Z plane to form a fourth plane of motion (FIG. 11). With respect to the inner longitudinal bars $\mathbf{104}_{5\text{-}6}$, the plane extends along the longitudinal axis of each longitudinal bar $\mathbf{104}_{5\text{-}6}$ from the first pivotal coupling member 120 and extends upward approximate 90 degrees along the Y-Z plane to form a fifth plane of motion (FIG. 10).

In this embodiment, referring to FIG. 13, the plates 142 of the first pivotal coupling member 120 are fixedly spaced apart by the intermediate member 144 a distance suitable for receiving the inner ends 106 of the longitudinal bars 104. The area between the plates 142 and interior surface of the intermediate member 144 form a groove opening 148 which faces upwardly with respect to the bed frame while in an open state, and which receives the adjacent inner ends 106 of the longitudinal bars 104. A fastener, such as a bolt, rod or other fastener (not shown) secure the inner ends 106 of the longitudinal bars 104. Specifically, a pair of bolts or rods extend through the pair of axially aligned bores 146 formed in the opposing plates 142, and each bolt or rod extends through a bore (not shown) formed through the inner and outer side walls of each inner end 106 of the longitudinal bars 104. The inner ends 106 of the longitudinal bars 104 pivot about the bolts or rods along the Y-Z plane (the fourth and fifth planes of motion) as described above to enable the bed frame 300 to be configured in an open or closed arrangement. The space provided on each side of the groove opening 148 allows the longitudinal bars 104 to pivot downward to a position normal to the intermediate member 144 when the bed frame 300 is in a folded state as shown in FIGS. 11 and 12. The bottom portion of each intermediate member 144 faces downwardly and an outer leg 134 or an auxiliary leg 136 is preferably fixedly attached (e.g., welded, snap fit, secured with a fastener), as shown, for example, in FIG. 18. In the alternative, the second pivotal coupling member 122 can be used to pivotally couple the longitudinal bars 104, and each leg 134, 136 can be fixed to a bottom portion of the plates 162 of the second pivotal coupling member 122 as shown, for example, in FIG. 17.

Referring to FIG. 9, each transverse beam 110 is formed by a pair of transverse bars 112 which are described in detail above with respect to the first embodiment and is incorporated by reference. In this embodiment, the shaft and sleeve portions 101, 103 are reversed in each transverse bar 112 bridging the first and third longitudinal beams $\mathbf{102}_1$ and $\mathbf{102}_3$. In the present embodiment, the shafts 101 are located at the first ends of the transverse bars 114 and the sleeves 103 are located at the second ends of the transverse bars 116. The transverse bar first ends 114 of each transverse beam are pivotally connected together with a sixth pivotal coupling member 141 as illustratively shown in FIG. 20.

Figure 20:
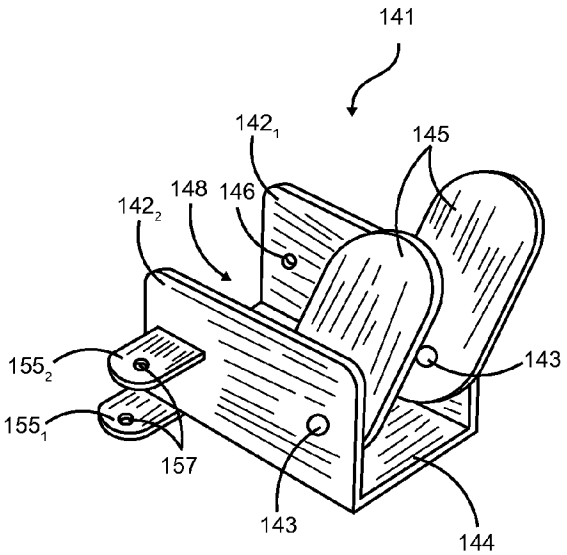
FIG. 20 is a bottom perspective view illustrating a sixth pivotal coupling member of the present invention.

Referring to FIG. 20, an example of a sixth pivotal coupling member 141 is shown. The sixth pivotal coupling member 141 provides pivotal connections for the transverse beam first ends 114 as well as the outer ends 108 of the third longitudinal beam $\mathbf{102}_3$. The sixth pivotal coupling member 141 includes a pair of opposing plates $\mathbf{142}_1$, $\mathbf{142}_2$ and an intermediate member 144 attached therebetween along top edges of the plates $\mathbf{142}_1$, $\mathbf{142}_2$ to form a central U-shaped bracket similar to that of the first pivotal coupling member 120 shown in FIG. 13, except that the intermediate member 144 fully extends along the top edges of the plates $\mathbf{142}_1$, $\mathbf{142}_2$. The two opposing plates $\mathbf{142}_1$, $\mathbf{142}_2$ are illustratively shown as being substantially rectangular in shape, however, such shape and configuration is not limiting. For example, the plates can be shaped oval. The plates 142$_1$, 142$_2$ are fixedly spaced apart by the intermediate member 144 a distance suitable for receiving the outer ends 108 of the longitudinal bars 104 of the third longitudinal beam 102$_3$ and an auxiliary leg 136. The area between the plates 142$_1$, 142$_2$ and interior surface of the intermediate member 144 form a groove opening 148 which faces downwardly with respect to the bed frame 300 while in an open state, and which receives the outer ends 108 of each longitudinal bar 104$_5$, 104$_6$ and an auxiliary leg 136.

A pair of bores 146 are formed proximate each outer end of the plates 142 and each pair of opposing bores 146 are aligned to receive a fastener, such as a bolt, rod or other fastener (not shown) to secure an auxiliary leg 136. Specifically, a bolt or rod extends through the pair of axially aligned bores 146 formed in the opposing plates 142 and a bore (not shown) formed through the side walls of each auxiliary leg 136 to form a pivotal connection.

An additional pair of bores (not shown) are formed proximate each inner end of the plates 142 to pivotally secure an outer end 108 of each longitudinal bar 104$_5$, 104$_6$. In the present embodiment, a fastener (e.g., a bolt or rod) 143 extends through each axially aligned bore (not shown) formed on each plate 142 and through a bore (not shown) formed through an extension plate 145 to form a pivotal connection. Each extension plate 145 is fixedly coupled (e.g., welded, snap fit, secured with a fastener) to the outer side walls of each outer end 108 of the longitudinal bars 104$_5$, 104$_6$. Alternatively, the side walls of each outer end 108 of the longitudinal bars 104$_5$, 104$_6$ can be provided with aligned bores and directly pivotally coupled to the opposing plates 142 by a continuous fastener.

The outer ends 108 of the longitudinal bars 104$_5$, 104$_6$ pivot about the fastener 143 of each sixth pivotal coupling member 141 along the Y-Z plane (the fifth plane of motion) as described above and the auxiliary legs 136 pivot about the fastener and bore 146 of each sixth pivotal coupling member 141 along a Y-Z plane of motion as shown in FIGS. 9-12 (i.e., a sixth plane of motion along a longitudinal axis of the auxiliary leg 136 from the sixth pivotal coupling member 141 extending along the Y-Z plane approximately ninety degrees outward) to enable the bed frame 300 to be configured in an open or closed arrangement. Each auxiliary leg 136 is extended to a length substantially similar to the overall length of the outer legs 134 and its attachments but some or all of the legs 134, 136 could be replaced by other extensions such as wheels, glides (stationary extensions) or risers (vertically adjustable extensions).

Referring to FIG. 10, opposing side walls of each auxiliary leg 136 further includes opposing and aligned apertures 147 and each corresponding longitudinal bar 104$_5$, 104$_6$ further includes a protrusion 149 (i.e., a bar or rod) extending from a corresponding side wall. An elongated flange 151 is pivotally coupled to the auxiliary leg aperture 147 on one end and a hook 153 is located on an opposing end of the elongated flange 151 such that the hook 153 engages the protrusion 149 when the bed frame 300 is in an open state to provide further stability to the center of the bed frame 300 as shown in FIG. 9. The hook 153 is disengaged and aligned with the auxiliary leg 136 when the bed frame 300 is in the folded state as shown in FIGS. 11 and 12.

Referring again to FIG. 20, each sixth pivotal coupling member 141 further includes a pair of side extensions 155$_1$, 155$_2$ extending from outer sides of the plates 142$_1$, 142$_2$ for receiving first ends of the transverse bars 114. In this embodiment, the side extension extending from the top portion of the U-shaped bracket 155$_1$ is a continuous plate extending the width of the sixth pivotal coupling member 141 and is fixed to the top surface of the intermediate member 144, as shown in FIG. 9, to provide additional stability to the pivotal connection of the transverse bars 112. The pair of side extensions 155$_1$, 155$_2$ includes opposing and aligned apertures 157. The top and bottom walls of each transverse bar inner end 114 also include corresponding aligned bores (not shown) such that the side extensions 155 and transverse bar inner ends 114 are coupled with a continuous bolt or rod (not shown) extending through the apertures 157 and bores to provide a pivotal connection.

Figure 21:
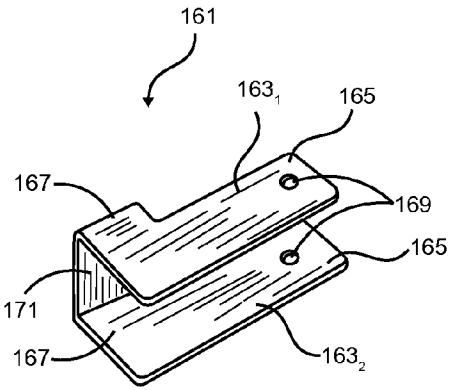
FIG. 21 is a perspective view illustrating a seventh pivotal coupling member of the present invention.

Referring to FIGS. 9 and 10, the second ends of each transverse bar 116 are pivotally coupled to the outer ends 108 of corresponding outer longitudinal bars 104$_{1-4}$ by a seventh pivotal coupling member 161 as shown in FIG. 21. The seventh pivotal coupling member 161 includes two opposing L-shaped plates 163$_1$, 163$_2$. Each L-shaped plate includes an elongated portion 165 having proximal and distal ends, and a transverse portion 167 extending normal from the proximal end of the elongated portion 165. The elongated portion 165 distal end includes opposing and aligned apertures 169. An intermediate member 171 extends from the outer edges of the opposing transverse portions 167. An inner side of the intermediate member 171 provides an engaging surface for the longitudinal bars 104 when the bed frame 300 is in a folded state as shown in FIGS. 11 and 12. Referring to FIGS. 9 and 10, an outer side of the intermediate member 171 is fixedly coupled (preferably by welding) to a side wall of each transverse bar second end 116 and each elongated portion 165 distal end is pivotally coupled to a corresponding longitudinal bar 104$_{1-4}$ outer end 108 by extending a fasteners (e.g., screw, rod or the like) through the apertures of the elongated portion distal ends 169 and bores (not shown) formed on the longitudinal bar 104$_{1-4}$ outer ends 108. Thus, the plane of motion for each transverse bar 112 is formed along the X-Y plane and extends 90 degrees from an aligned position, as shown in FIG. 9, to a position where the transverse bars 112 are parallel and adjacent to each other as shown in FIG. 11, a seventh plane of motion.

The bed frame 300 of the third embodiment also includes end flanges 121 and side flanges 135, which are described in detail above in the description of the bed frame 100 of the first embodiment.

In operation, referring to FIG. 10, to fold the bed frame 300, the hooks 153 of the elongated flanges 151 are detached from the protrusions 149 of the inner longitudinal bars 104$_5$, 104$_6$. The paired second ends 116 of the two transverse bars 112 forming each of the two transverse beams 110 are rotated inwardly about the seventh pivotal coupling member 161 and the inner longitudinal bars 104$_5$, 104$_6$ are rotated downwardly about the sixth pivotal coupling member 141. The outer longitudinal bars 104$_1$,104$_3$ and 104$_2$, 104$_4$, corresponding transverse bars 112, corresponding auxiliary legs 136 and corresponding elongated flanges 151 are arranged parallel and adjacent to each other; and the inner longitudinal bars 104$_5$ and 104$_6$ are arranged parallel and adjacent to each other to form three separate groupings as shown in FIG. 11. The outer groupings (i.e., the folded first transverse beam 110$_1$ and outer longitudinal bars 104$_1$, 104$_3$; and the folded second transverse beam 110$_2$ and outer longitudinal bars 104$_2$, 104$_4$ are then folded inwardly toward the folded inner longitudinal bars 104$_5$, 104$_6$ about their respective first pivotal coupling members 120. The end flanges 121 and the side flanges 135 are rotated inward and downward, respectively. Thus, the longitudinal bars 104 and the transverse bars 112 are positioned together in at least a substantially parallel arrangement as shown in FIG. 12 to significantly reduce the overall footprint of the bed frame 300, thereby making it easier to transport and store.

A person of ordinary skill in the art will appreciate that the bed frame 300 can be opened fully by reversing the folding actions set forth and described above. As described above in the description of the bed frame of the first embodiment 100, the width of the bed frame 300 can be adjusted by disengaging the locking pin 107 of each transverse bar 112; shifting the shaft and sleeve 101, 103 of each transverse bar 112; and engaging the locking pin 107 with a sleeve aperture 109 corresponding to a desired predetermined position. The process of adjusting the bed frame width is simplified when performed while the bed frame 300 is in the partially folded position as shown in FIG. 11 due to the closer proximity of the locking pins 107 of opposing transverse bars 112 of each transverse beam 110.

Fourth Embodiment

Figure 22:
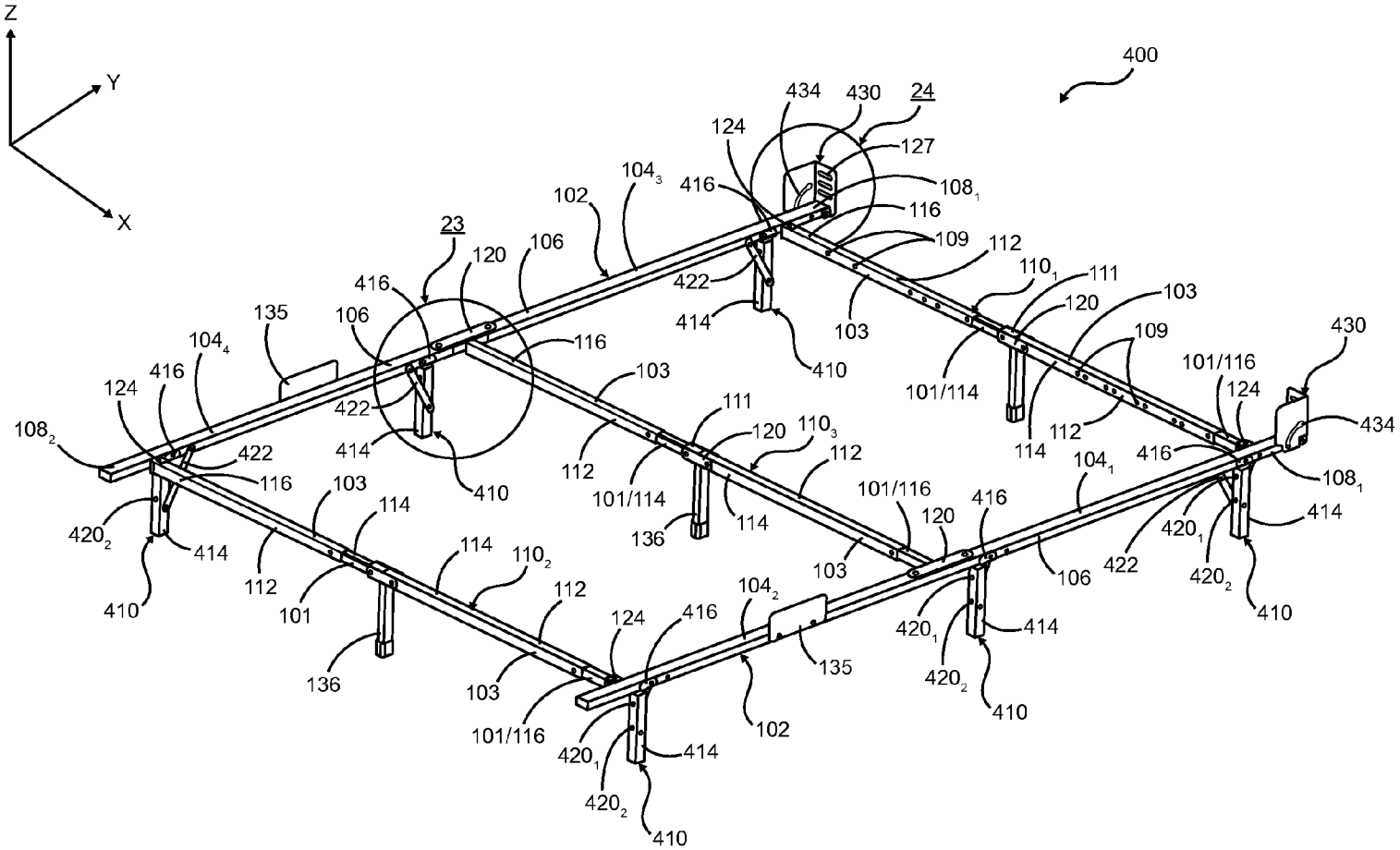
FIG. 22 is a perspective view illustrating a fourth embodiment of an adjustable folding bed frame of the present invention.

Referring to FIG. 22, a fourth embodiment of an adjustable folding bed frame 400 of the present invention is shown. The bed frame 400, including the folding operation, is substantially similar to the bed frame of the first embodiment 100, which is shown in FIGS. 1-3 and described in detail above, except that the bed frame 400 includes an alternative embodiment of legs or leg assemblies 410 (denoted "23" in reference to FIG. 23) and an alternative embodiment of an end flange or headboard plate assembly 430. Therefore, all features of the bed frame of the fourth embodiment 400 which are identical to the bed frame of the first embodiment 100 (described in detail above) are incorporated by reference in this section while the alternative features, i.e., the leg assembly 410 and the headboard plate assembly 430, are described below.

Figure 23:
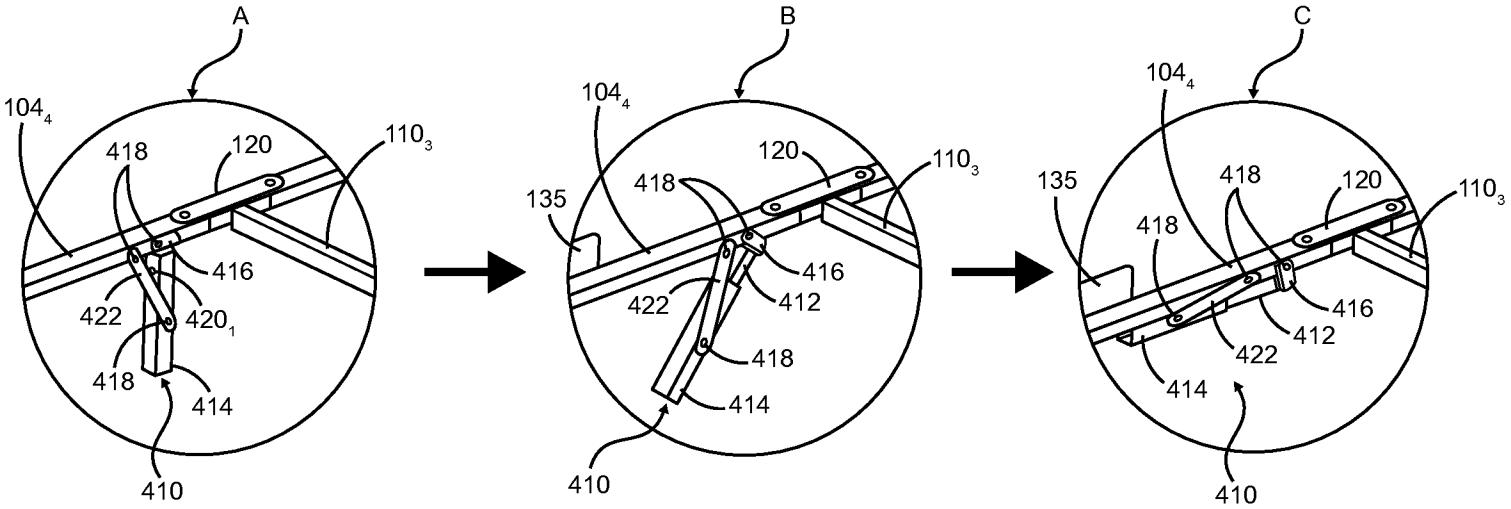
FIG. 23 is a perspective view illustrating an alternative embodiment of a leg assembly of the present invention in an extended state, a partially folded state and a folded state.

Referring to FIGS. 22 and 23, the bed frame 400 includes a plurality of leg assemblies 410. In this embodiment, the bed frame 400 includes six identical leg assemblies 410 which are illustratively shown in FIG. 23. Each leg assembly 410 includes a first leg member 412 slidably coupled within a second leg member 414. Each of the first and second leg members 412, 414 are constructed of a high-strength metal and is hollow with a substantially square cross-section. The outer peripheral dimensions of the first leg member 412 is substantially similar to the inner peripheral dimensions of the second leg member 414 such that the first leg member 412 is slidable within the second leg member 414. One of ordinary skill in the art will recognize that other high-strength materials such as plastics could be used and other cross-section shapes such as circular could be used without departing from the spirit and scope of the present invention. An upper side of the first leg member 412 is fixedly coupled, preferably by welding, to an eighth pivotal coupling member 416. The eighth pivotal coupling member 416 is substantially U-shaped and pivotally coupled to opposing side portions of each longitudinal bar 104 with a fastener 418, such as a screw, nut and bolt combination, rivet or the like, which extends laterally through the longitudinal bars 104 to form a pivoting axis. The first leg member 412 also includes a spring-biased locking member (not shown) disposed within the hollow portion of the first leg member 412 which extends through an aperture (not shown) normal to a side surface of first leg member 412. The second leg member 414 includes a pair of spaced apart upper and lower apertures $\mathbf{420}_1$, $\mathbf{420}_2$ extending through a side portion of the second leg member 414 corresponding to the side surface of the first leg member 412 from which the locking member extends. To provide additional support to the leg assembly 410, a leg support brace 422 is fixedly pivotally coupled to the second leg member 414 on one end and an inner side of the longitudinal bar 104 on an opposing end by fasteners 418 such as a screw, nut and bolt combination, rivet or the like. In an operating state, the locking member of the first leg member 412 engages an lower aperture $\mathbf{420}_2$ and the leg assembly 410 is securely extended downward from and perpendicular to the longitudinal bar 104 as shown in "A" of FIG. 23. The leg assembly 410 is folded by depressing the locking member of the first leg member 412 to disengage from the lower aperture $\mathbf{420}_2$ and the second leg member 414 is slidably extended toward the lower side of the longitudinal bar 104 as shown in "B" of FIG. 23. The locking member of the first leg member 412 is engaged with the upper aperture $\mathbf{420}_1$ and locked into a folded state as shown in "C" of FIG. 23. It is preferred that a leg assembly 410 is provided at each corner of the bed frame 400 and at each opposing longitudinal beam 102 intermediate opposing ends. The leg assemblies 410 located intermediate opposing ends of each longitudinal beam 102 provide additional support for the center portion of the bed frame and are disposed adjacent to the first pivotal coupling members 120 and folded away from the first pivotal coupling members 120 to avoid interfering with the folding operation of the bed frame 400. The pivotal leg assemblies 410 eliminates the requirement of attaching and detaching extensions such as wheels, glides, risers and the like.

Figure 24:
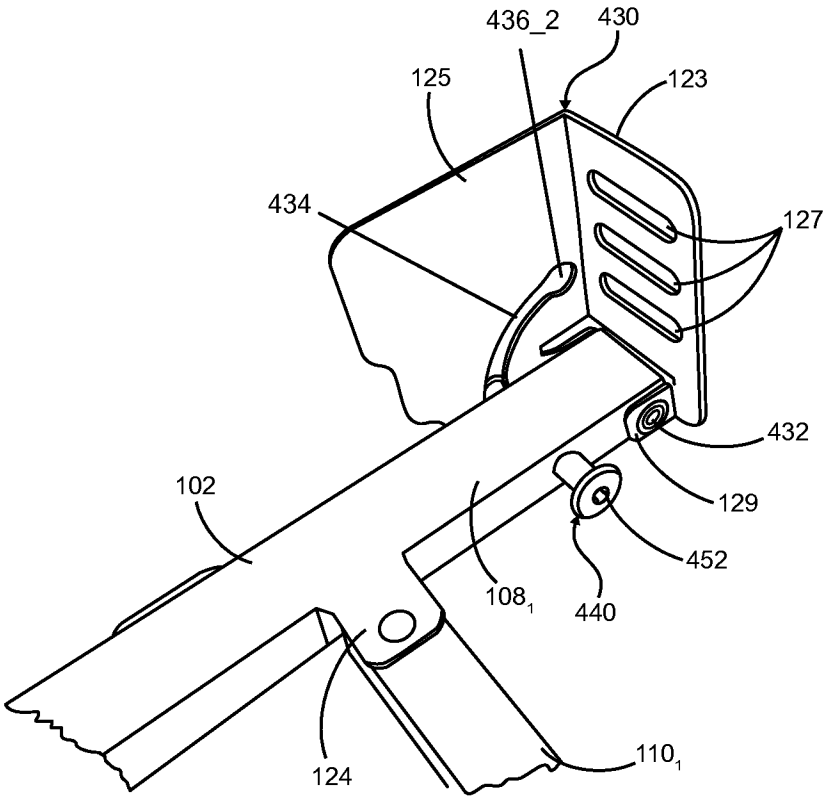
FIG. 24 is a perspective view of an alternative embodiment of an end flange or headboard plate assembly of the present invention.
Figure 33:
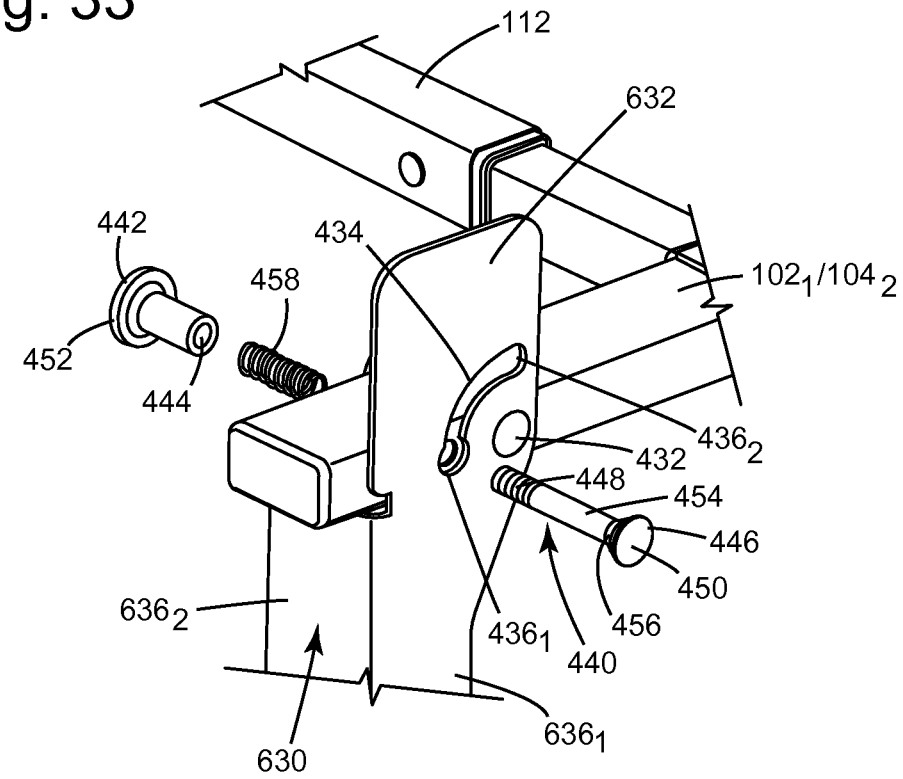
FIG. 33 is an exploded view of a locking member of the leg assembly of FIG. 32.
Figure 34:
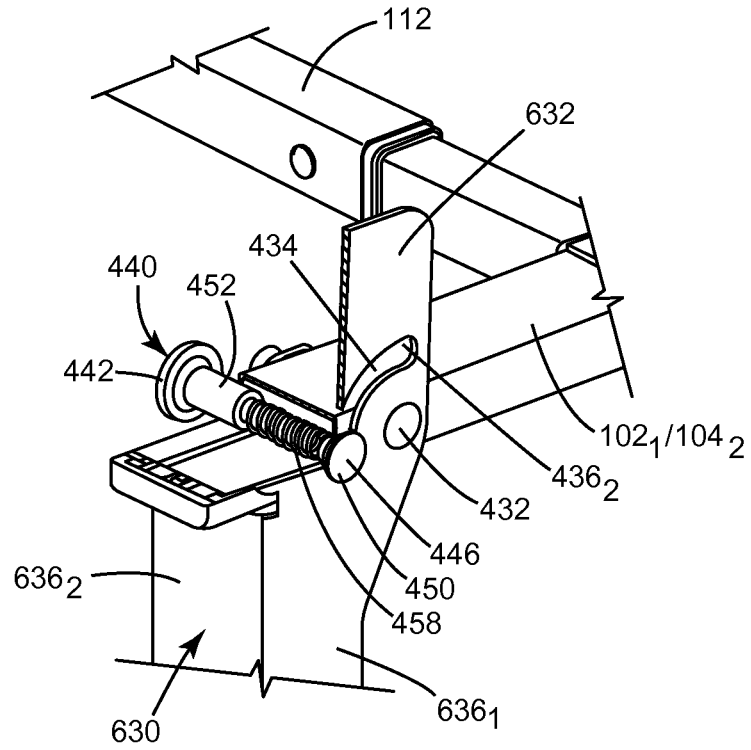
FIG. 34 is a partial sectional view of the leg assembly of FIG. 32.
Figure 35:
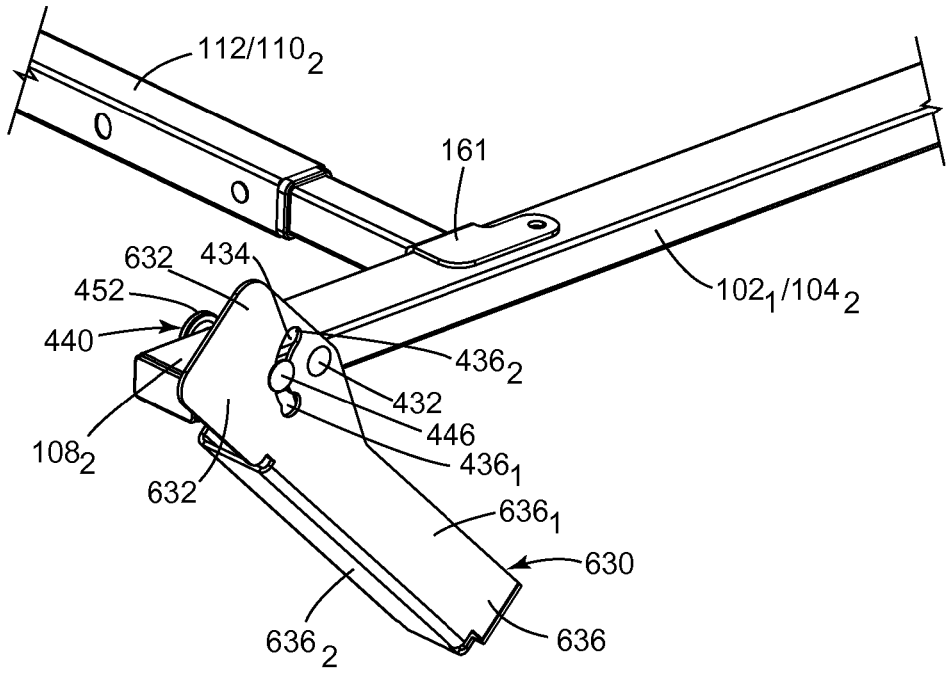
FIG. 35 is a perspective view of the leg assembly of FIG. 32 in a partially folded state.
Figure 36:
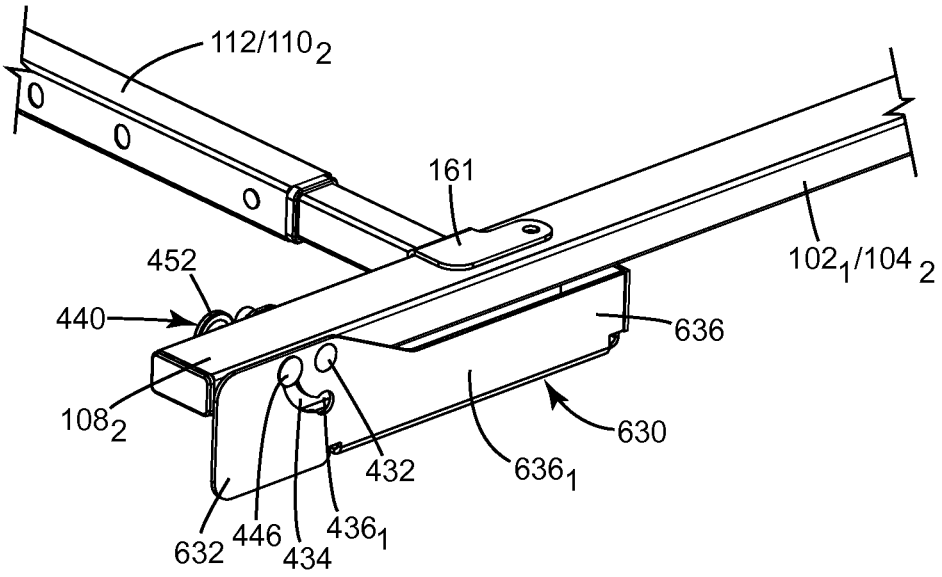
FIG. 36 is a perspective view of the leg assembly of FIG. 32 in a folded state.

Referring to FIGS. 22 and 24, an alternative embodiment of an end flange or headboard plate assembly 430 is shown. FIG. 24 shows the headboard plate assembly 430 denoted "24" in FIG. 22. Similar to the end flange 121 of the first embodiment of the bed frame 100, as shown for example in FIG. 1, each L-shaped headboard plate assembly 430 is formed by an adjoining back plate 123 and a side plate 125. It is preferred that the back plate 123 and the side plate 125 are integrally formed by bending a continuous sheet of metal but separate sheets could be welded together as well. The back plate 123 has slots 127 for attaching the bed frame 400 to a headboard (not shown), and further includes an extension 129 extending normal from the back plate 123 and parallel to the side plate 125. Each headboard plate assembly 430 is positioned at the outermost end of each longitudinal beam first end $\mathbf{108}_1$ to prevent a box spring or mattress (not shown) from shifting longitudinally past the headboard plate assembly 430. Each headboard plate assembly 430 extends upward and is pivotally connected to each longitudinal beam free end $\mathbf{108}_1$ with a fastener 432, such as a screw, rivet, nut and bolt combination or the like, which extends through the side plate 125, longitudinal beam 102 and extension 129 for the headboard plate assembly 430 to pivot inward ninety degrees such that the back plate 123 is positioned on an upper surface of the longitudinal beam 102 when the bed frame 400 is folded (see, e.g., FIGS. 3, 8 and 12). In this embodiment, the side plate 125 also includes an elongated curved channel 434 having opposing ends $\mathbf{436}_1$ and $\mathbf{436}_2$. The channel 434 has a uniform width while each channel end $\mathbf{436}_1$ and $\mathbf{436}_2$ has a substantially circular aperture integrally formed with the channel 434 and having a diameter greater than the width of the channel 434. A substantially cylindrical locking device 440 extends through opposing side surfaces of the longitudinal beam 102 and through the channel 434. Referring to FIGS. 33 and 34 for purposes of describing the locking device 440, the locking device 440 includes a male portion 446, preferably a metal bolt with threads 448 on one end and a bolt head 450 on an opposing end, and a female portion 452 having a button section 442 and a hollow interior section 444 having matching threads (not shown) for engaging with the threads of the male portion 448. One of ordinary skill in the art will recognize that other threaded fasteners of other materials could be used, such as, for example, a high-strength plastic. The male portion 446 includes an inner portion 454 having a diameter substantially similar to the channel width and an outer portion 456 having a diameter greater than the channel width, while the diameter of the bolt head 450 is greater than the diameter of the channel end 436. A torsion spring 458 surrounds the male portion 446 while the male and female portions 446, 452 are coupled by threaded engagement, and the spring portion 458 is disposed within the longitudinal beam 102 as shown in FIG. 34. The torsion spring 458 is positioned between an inner side surface of the longitudinal beam 102 and the an inner end of the female portion 452, such that the female portion 452 is biased away from the longitudinal beam 102 and the male portion 446 is biased toward the longitudinal beam 102 and side plate 125. In operation, the male outer portion 456 is engaged with a lower channel end $\mathbf{436}_1$ and the headboard plate assembly 430 is fixed in the operating state as shown in FIG. 24. To fold the headboard plate assembly 430, the female button section 442 is depressed so that the male outer portion 456 disengages the lower channel end $\mathbf{436}_1$ and the male inner portion 454 engages the channel 434. The headboard plate assembly 430 is pivoted inward about the fastener 432 until the male inner portion 454 disengages the channel 434 and the male outer portion 456 engages the upper channel end $\mathbf{436}_2$. The curvature of the channel 434 is such that it corresponds to the pivotal movement of the headboard plate assembly 430 and the channel ends 436 are positioned such that the headboard plate assembly 430 is substantially perpendicular to the longitudinal beam 102 when the locking device 440 is engaged with the lower channel end $\mathbf{436}_1$ and the back plate 123 is substantially parallel to the longitudinal beam 102 when the locking device 440 is engaged with the upper channel end $\mathbf{436}_2$.

Referring to FIGS. 22, 25 and 26, the bed frame 400 also includes a side flange or side support member 135 which is described in detail above with respect to the bed frame of the first embodiment 100 and incorporated by reference to this section. In this embodiment, the side flange 135 is positioned on each opposing longitudinal bar $\mathbf{104}_2$ and $\mathbf{104}_4$ closer to the free ends or foot portion of the bed frame $\mathbf{108}_2$ and away from the center portion of the longitudinal beams 102 to accommodate for the components of the leg assembly 410 near the center portion of the longitudinal beams 102. However, one with skill in the art with recognize that the positions of the leg assemblies 410 and the side flanges 135 could vary without departing from the spirit and scope of the present invention.

Fifth Embodiment

Figure 27:
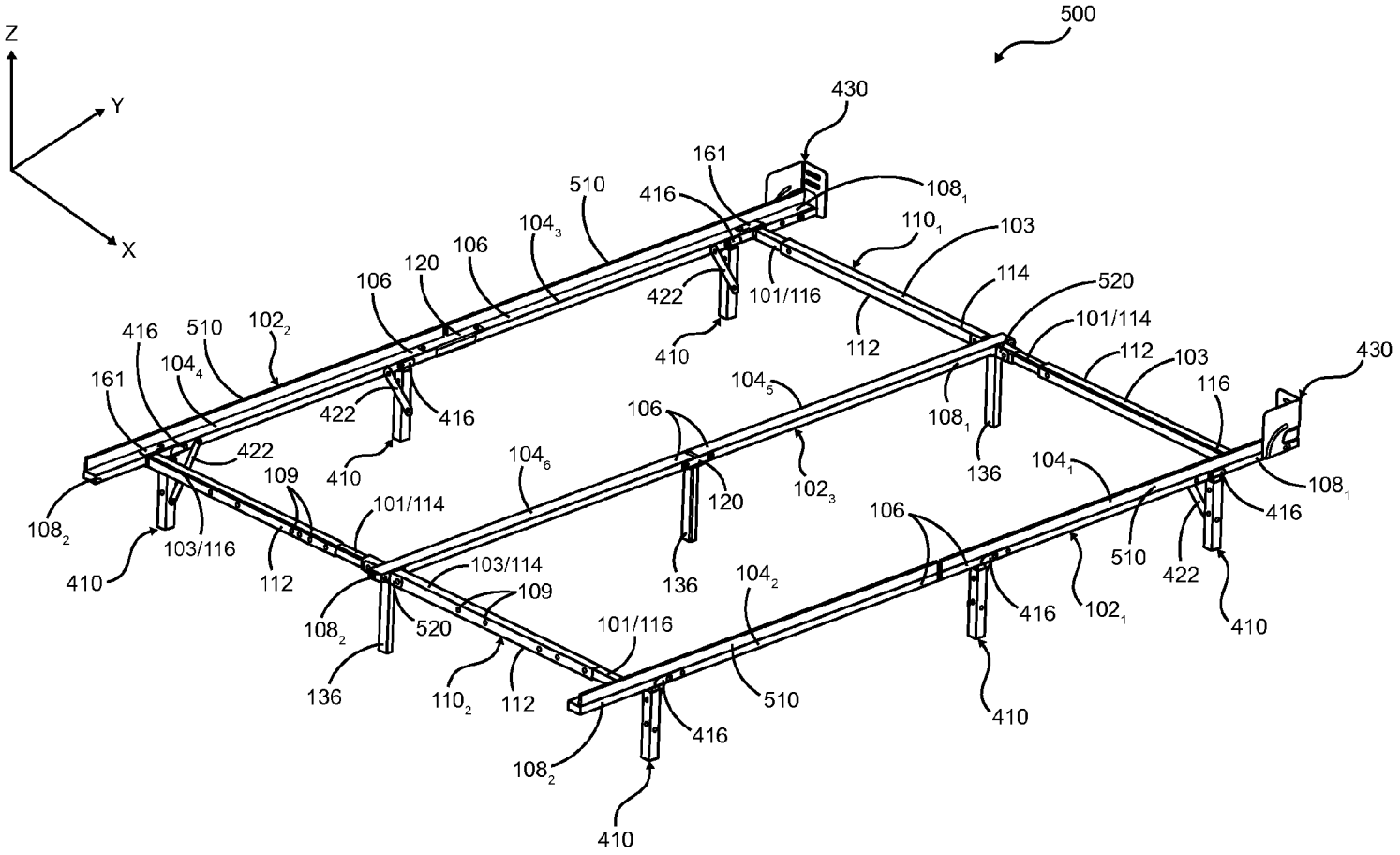
FIG. 27 is a perspective view of a fifth embodiment of an adjustable folding bed frame of the present invention in an expanded state.

Referring to FIG. 27, a fifth embodiment of an adjustable folding bed frame 500 of the present invention is shown. The construction of the bed frame 500 is similar or identical the bed frame of the third embodiment 300 shown in FIG. 9 with a few exceptions, which are described below. The components in the bed frame of the fifth embodiment 500 which are identical to the bed frame of the third embodiment 300 have identical numbers and are described in detail above in the description of the third embodiment, and those portions of the discussion are incorporated by reference in this section.

Referring again to FIG. 27, the longitudinal bars $\mathbf{104}_1$, $\mathbf{104}_2$ and $\mathbf{104}_3$, $\mathbf{104}_4$ of each of the first and second longitudinal beams $\mathbf{102}_1$ and $\mathbf{102}_2$, respectively, are pivotally coupled at inner ends 106 by the first pivotal coupling member 120 such that the longitudinal bars $\mathbf{104}_{1\text{-}4}$ are pivotable about the Z-axis and within the groove opening 148 of the first pivotal coupling member 120. Each longitudinal bar $\mathbf{104}_1$, $\mathbf{104}_2$, $\mathbf{104}_3$, $\mathbf{104}_4$ includes an integrally formed (preferably welded) side support member 510 extending upward from and substantially aligned with an outer side of each longitudinal bar 104. Each side support member 510 extends the length of each respective longitudinal bar 104 and secures a mattress or box spring from shifting laterally during use.

Figure 37:
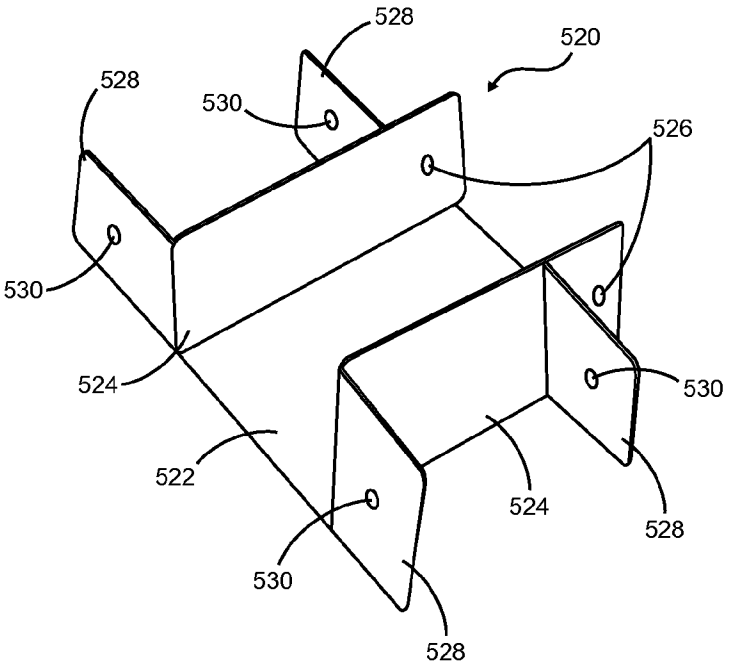
FIG. 37 is a perspective view of another embodiment of a pivotal coupling member of the present invention.
Figure 37:
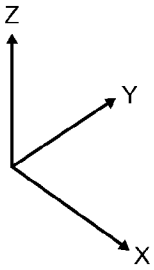

As shown in FIG. 27, the transverse bars 112 of each first and second transverse beam $\mathbf{110}_1$ and $\mathbf{110}_2$ are pivotally coupled together with a ninth pivotal coupling member 520 for pivotal movement about the Y-axis. Referring to FIG. 37, the ninth pivotal coupling member 520 includes a U-shaped central member having a base 522 and a pair of opposing side walls 524 extending upwardly substantially perpendicular to the base 522. Distal ends of each side wall 524 include opposing apertures 526 aligned along the X-axis. A pair of opposing transverse walls 528 extend normally from each outer surface of the side walls 524 and include opposing apertures 530 aligned along the Y-axis. Referring to FIG. 27, each pair of transverse bars 112 of each first and second transverse beam $\mathbf{110}_1$ and $\mathbf{110}_2$ are pivotally coupled to each pair of opposing transverse walls 528 at opposing apertures 530 by a fastener (not shown) for pivotal movement about the Y-axis. Each longitudinal bar $\mathbf{104}_5$, $\mathbf{104}_6$ of the third longitudinal beam $\mathbf{102}_3$ is pivotally coupled to the pair of side walls 524 at opposing apertures 526 by a fastener (not shown) for pivotal movement about the X-axis. A top surface of the base 522 also provides support for each of the longitudinal bars $\mathbf{104}_5$, $\mathbf{104}_6$ when the bed frame 500 is in an open or expanded configuration. An auxiliary leg 136 is fixedly coupled to a bottom surface of the base 522, preferably by welding, and extends substantially perpendicular from the base 522.

Referring to FIG. 27, the bed frame 500 includes a plurality of leg assemblies 410, as described above and shown in FIG. 23. Each leg assembly 410 is pivotally coupled to each longitudinal bar 104 proximate each free end 108 and also pivotally coupled to each of the first and second longitudinal beams $\mathbf{102}_1$ and $\mathbf{102}_2$ intermediate the free ends 108. The bed frame 500 also includes a pair of headboard plate assemblies as detailed above and shown in FIG. 24.

Figure 29:
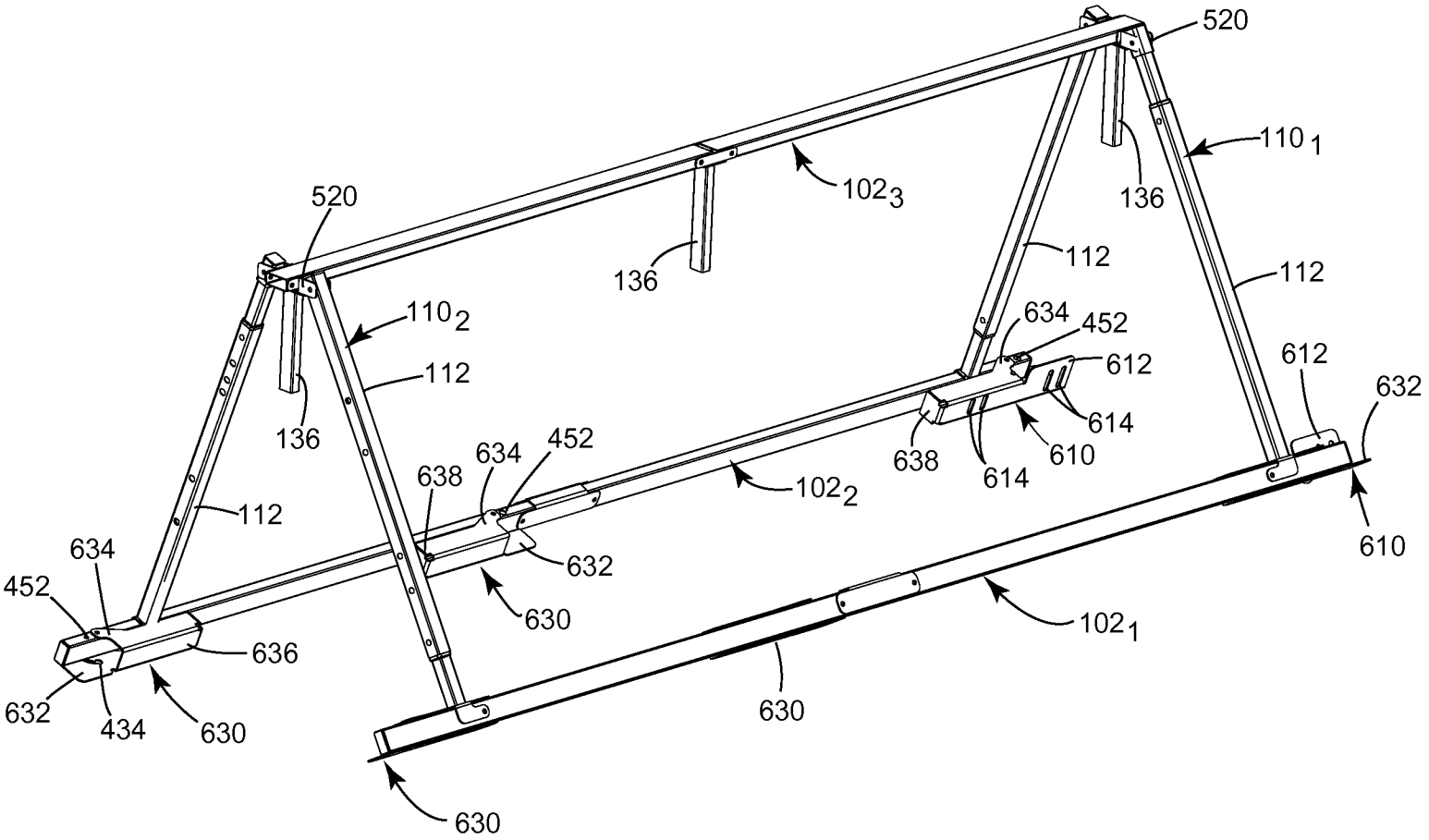
FIG. 29 is a perspective view of the adjustable folding bed frame of FIG. 28 in a first partially folded state.
Figure 30:
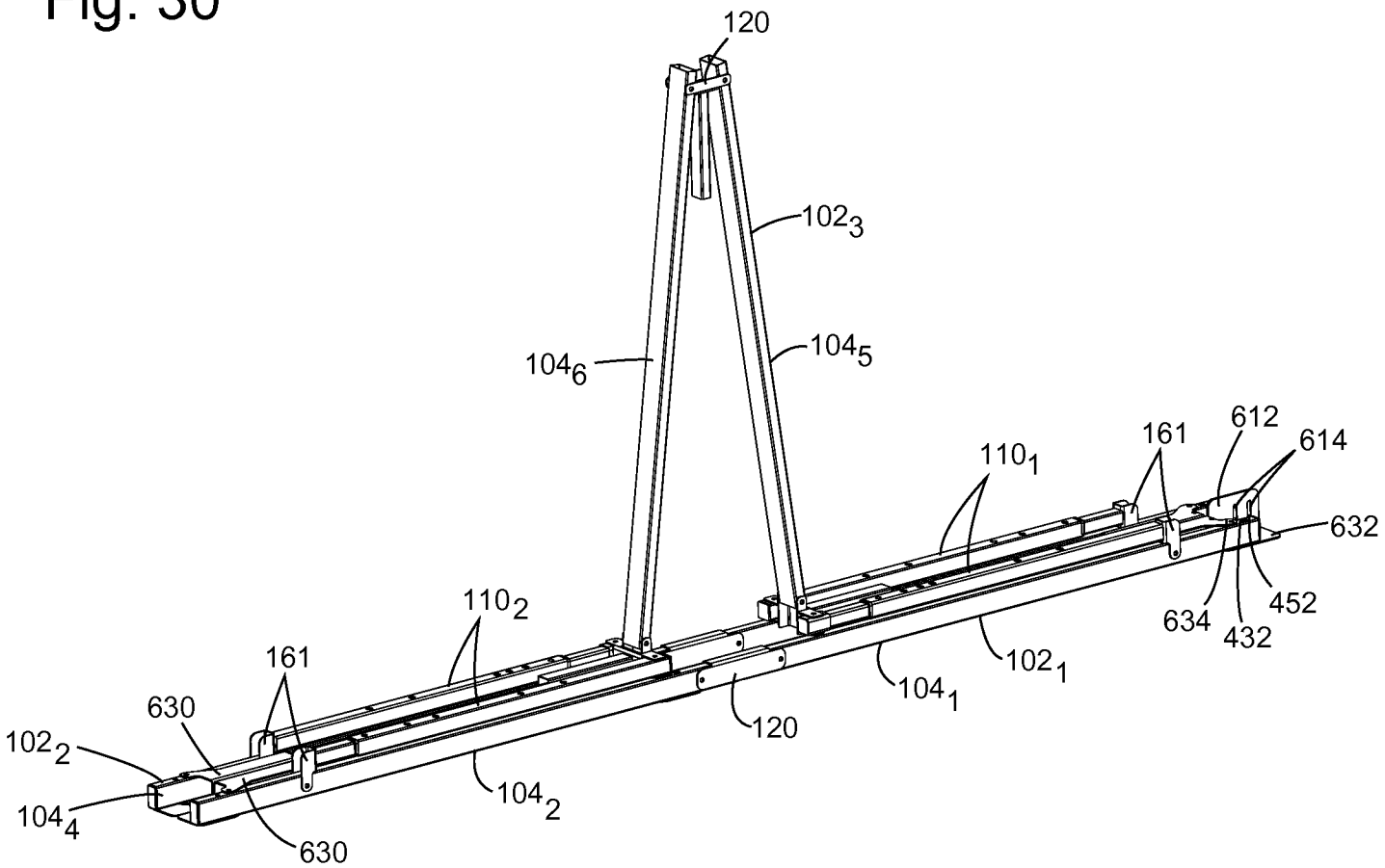
FIG. 30 is a perspective view of the adjustable folding bed frame of FIG. 28 in a second partially folded state.
Figure 31:
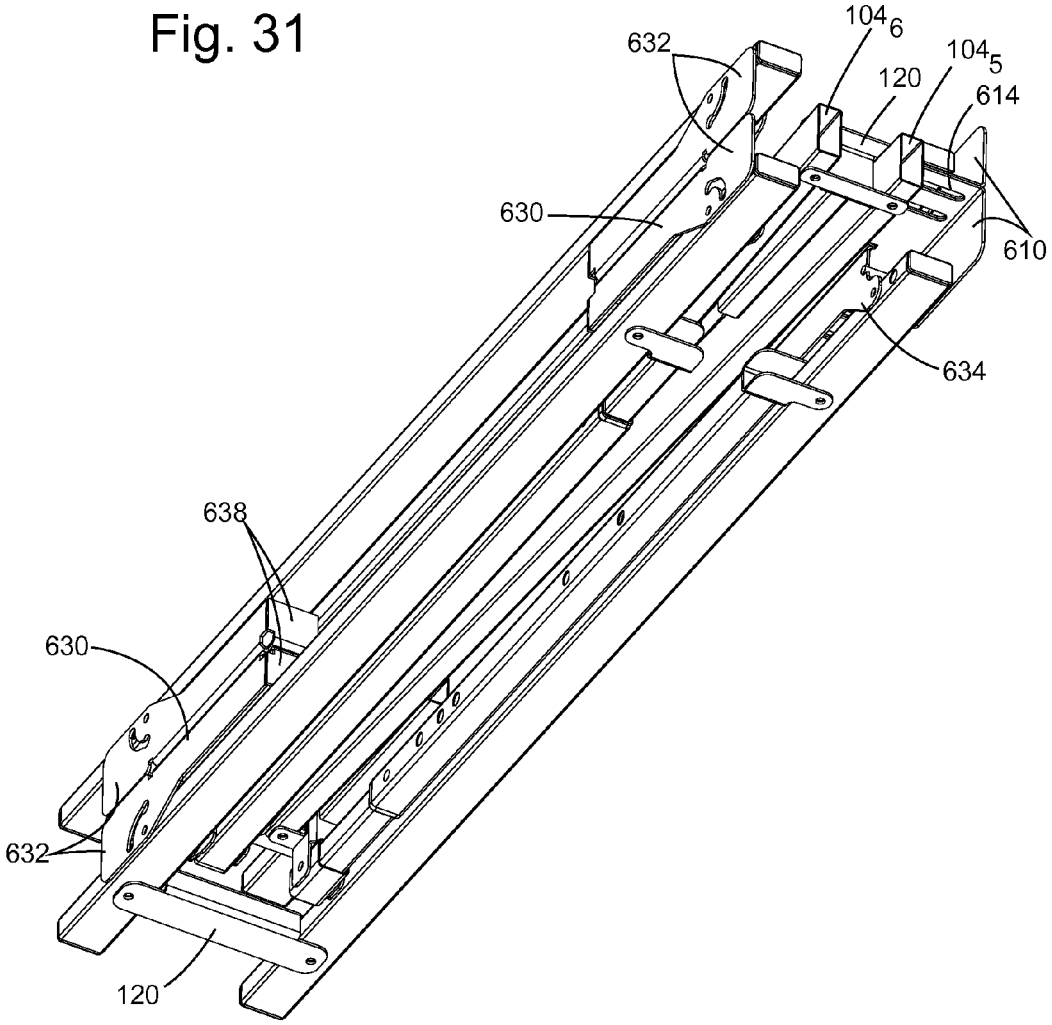
FIG. 31 is a perspective view of the adjustable folding bed frame of FIG. 28 in a folded state.
Figure 32:
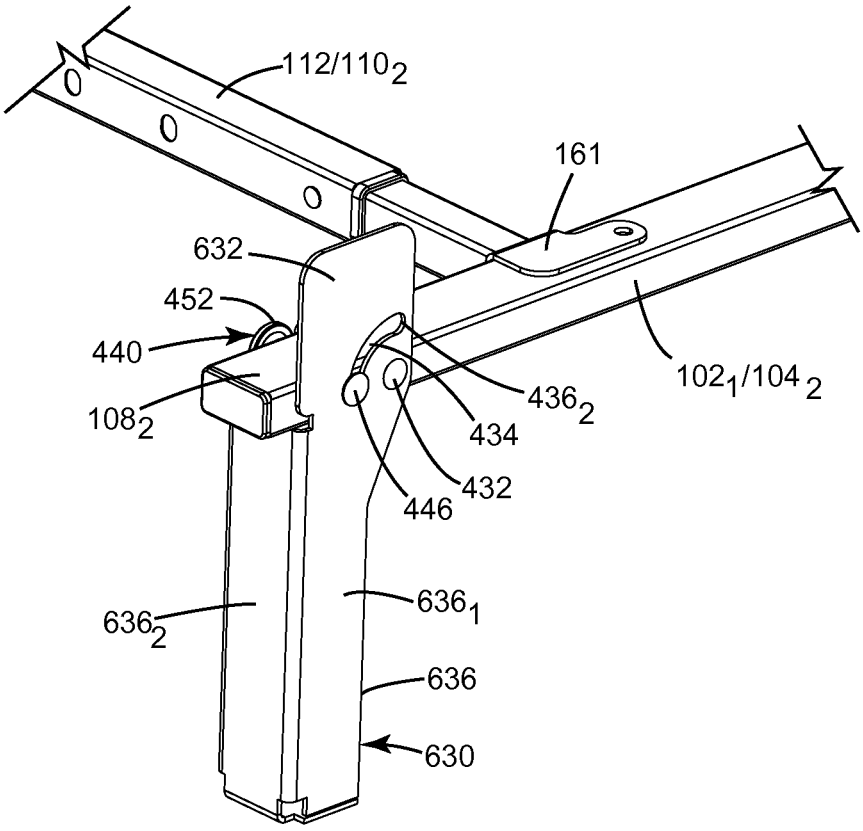
FIG. 32 is a perspective view of an alternative embodiment of a leg assembly of the present invention.

Referring to FIGS. 29-31, for illustrative purposes of showing the folding operation of the bed frame 500, the bed frame 500 is folded by rotating the leg assemblies 410 and headboard plate assemblies 430 toward the respective longitudinal beams 102. Each pair of transverse bars 112 of each transverse beam $\mathbf{110}_1$, $\mathbf{110}_2$ is rotated downward with respect to each ninth pivotal coupling member 520, as shown in FIG. 29, such that the transverse bars of each transverse beam 112 are substantially parallel and adjacent to each other and opposing first and second longitudinal beams $\mathbf{102}_1$, $\mathbf{102}_2$ are substantially parallel and adjacent to each other. Each pair of folded transverse bars 112 are rotated downward with respect to each seventh pivotal coupling member 161 toward the first and second longitudinal beams $\mathbf{102}_1$, $\mathbf{102}_2$, and the longitudinal bars $\mathbf{104}_5$, $\mathbf{104}_6$ of the third longitudinal beam $\mathbf{102}_3$ are simultaneously rotated downward with respect to the first pivotal coupling member 120 of the third longitudinal beam $\mathbf{102}_3$ such that each pair of folded transverse bars 112 are substantially parallel and adjacent to the longitudinal bars $\mathbf{104}_{1\text{-}4}$ of opposing first and second longitudinal beams $\mathbf{102}_{1\text{-}2}$ and the folded longitudinal bars $\mathbf{104}_{5\text{-}6}$ of the third longitudinal beam $\mathbf{102}_3$ are substantially parallel and adjacent to each other and positioned substantially perpendicular to the first and second longitudinal beams $\mathbf{102}_{1\text{-}2}$ and the folded transverse beams $\mathbf{110}_{1\text{-}2}$, as shown in FIG. 30. The opposing longitudinal bars of the first and second longitudinal beams $\mathbf{104}_{1\text{-}4}$ and the folded transverse beams $\mathbf{110}_{1\text{-}2}$ are collectively rotated toward the folded longitudinal bars $\mathbf{104}_{5\text{-}6}$ of the folded third longitudinal beam $102_3$ such that the transverse bars and longitudinal bars 112 and 104 are collectively substantially parallel and adjacent to each other, as shown in FIG. 31.

Sixth Embodiment

Referring to FIGS. 28-31, a sixth and preferred embodiment of an adjustable folding bed frame 600 of the present invention is shown. The bed frame in this embodiment 600 is identical to the bed frame of the fifth embodiment 500, including the folding operation, except that the leg assemblies 410, headboard assembly 430 and side support members 510 are replaced by integral headboard leg assemblies 610 and side leg assemblies 630. Therefore, the components that are identical between the two bed frames 500 and 600 are identically numbered in the figures and the description of those identical components are incorporated by reference from above.

Figure 28:
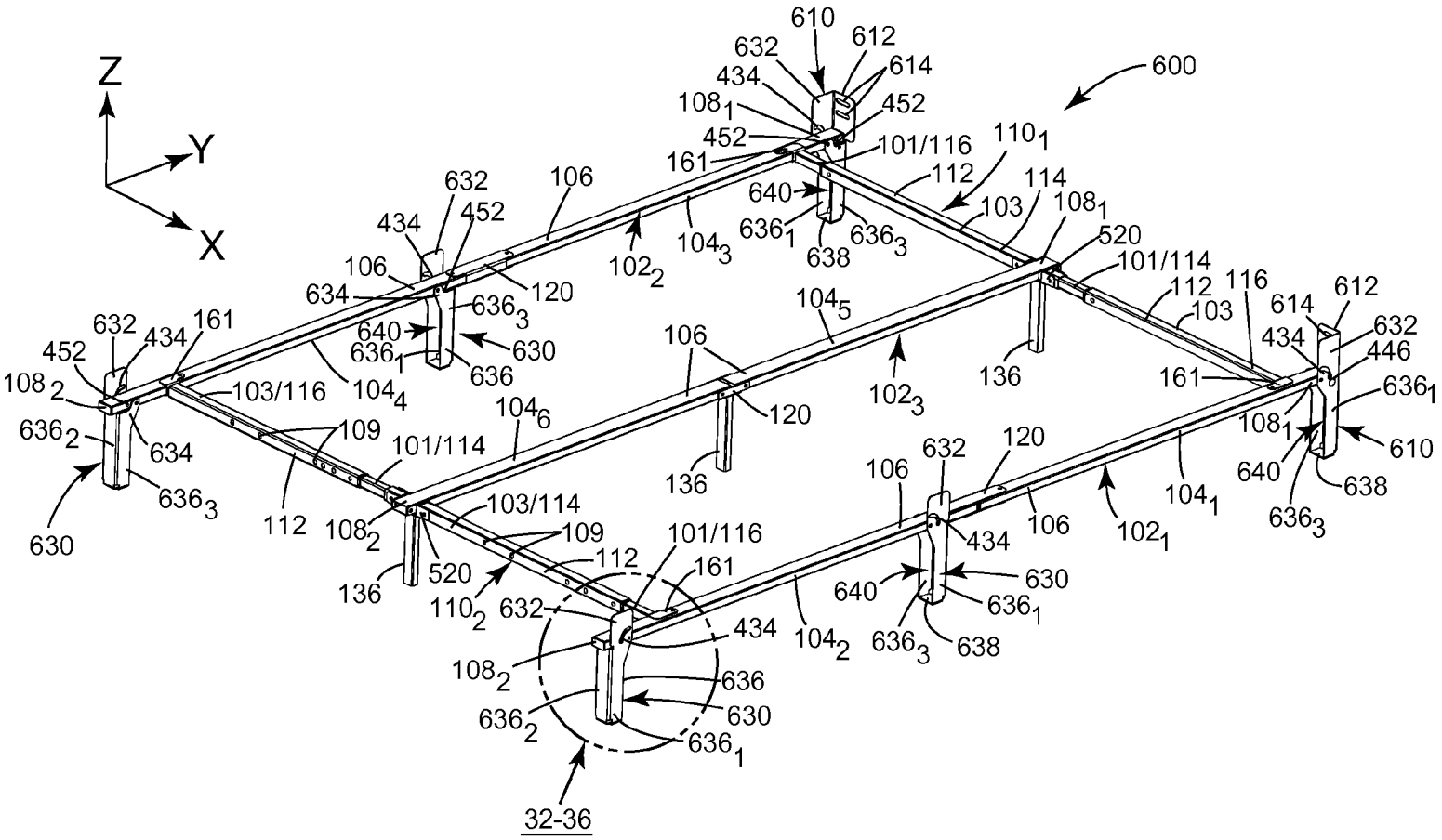
FIG. 28 is a perspective view of a sixth embodiment of an adjustable folding bed frame of the present invention in an expanded state.

Referring to FIG. 28, the bed frame 600 includes a plurality of vertical supports. The central portion of the bed frame 600 is supported by three auxiliary legs 136 which are fixedly attached to lower sections of the third longitudinal beam $102_3$. Specifically, each auxiliary leg 136 is welded onto lower sections of the first pivotal coupling member 120 and the ninth pivotal coupling members 520 as described above. The first and second longitudinal beams $102_1$ and $102_2$ are each supported by three vertical supports. Specifically, the longitudinal bars at a lower body portion of the bed frame $104_2$ and $104_4$ are each supported by two side leg assemblies 630 and an upper body portion of the bed frame $104_1$ and $104_3$ are each supported by a headboard leg assembly 610. The auxiliary legs 136, side leg assemblies 630 and headboard leg assembly 610 are substantially similar in length such that a level surface is provided when the bed frame 600 is in use. One of ordinary skill in the art will recognize that the side leg assemblies 630 could be positioned at other portions of the longitudinal beams $102_1$ and $102_2$ without departing from the spirit and scope of the invention. Moreover, each longitudinal beam $102_{1-3}$ could be provided with two vertical supports instead of three.

Referring to FIGS. 28-36, the side leg assembly 630 of the present embodiment is shown. The particular side leg assembly 630 in FIG. 28 denoted as "32-36" is shown in more detail in FIGS. 32-36 for illustrative purposes. Each side leg assembly 630 is constructed of a continuous sheet of metal which is cut to shape and formed by bending the sheet of metal along predetermined lines such that a three-sided substantially U-shaped vertical portion 636 having first, second and third side walls $636_{1-3}$ is formed with a bottom support surface 638 (FIGS. 28, 29 and 31) fixedly bridging a lower end of at least one of the side walls $636_{1-3}$. The bottom support surface 638 could also be fixed to the side walls $636_{1-3}$ by conventional welding methods. A vertical void 640 (FIG. 28) extends upwardly from the bottom support surface 638 between the vertical side walls $636_{1-3}$. The required material to form the vertical portion 636 is reduced substantially by eliminating a fourth side wall and the vertical void 640 provides space for the longitudinal beams 102 to engage with for compactly folding the leg assemblies 610, 630. A side plate 632 is integrally formed with and extends upwardly from the first side wall $636_1$, and a coupling extension 634 (FIG. 28) extends upwardly from the opposing third side wall $636_3$ substantially parallel to the first side wall $363_1$. The side plate 632 is formed with a channel 434 and is lockable via the locking device 440, and each side leg assembly 630 is pivotally coupled to the longitudinal bars $104_2$ and $104_4$ through the side plate 632 and the coupling extension 634 by the fastener 432 for pivotal movement about the X-axis, as described above and shown in FIGS. 33 and 34. Each side leg assembly 630 is pivotable to and from a locked operating state and a locked folded state, as shown in FIGS. 32-36 and described in detail above with respect to the headboard plate assembly 430 of the bed frame of the fourth and fifth embodiments 400, 500.

Referring to FIG. 28, each headboard leg assembly 610 is identical to the side leg assembly 630 except that a back plate 612 extends upwardly from the second side wall $636_2$ and is integrally formed with the side plate 632. Referring to FIG. 29, the back plate 612 and the second side wall $636_2$ include a plurality of slots 614 for attaching a headboard (not shown) to the headboard leg assembly 610.

Both vertical and lateral support is provided by integrally forming a vertical portion or legs 636 and side plates 632 for each side leg assembly 630. The addition of an integral back plate 612 for the headboard leg assembly 610 provides additional lateral support in the longitudinal direction while providing a means for attaching a headboard. Moreover, each leg assembly 610 and 630 is securely locked in the operating state to provide assured stability while the bed frame 600 is in use (FIG. 28) and securely locked in the folded state to assure that the leg assemblies 610 and 630 do not unexpectedly rotate during storage, transport or while opening the bed frame 600. The integral leg assemblies 610 and 630 also require less raw material and components compared to fabricating separate devices (i.e., separate leg, side flange and end flange) and thus manufacturing cost is reduced.

CONCLUSION

The present invention illustrates six adjustable folding bed frame embodiments 100, 200, 300, 400, 500 and 600, each of which are constructed such that both the longitudinal beams 102 and the transverse beams 110 of the bed frames 100, 200, 300, 400, 500 an 600 are formed by pairs of axially aligned bars (i.e., longitudinal bars 104 and transverse bars 112) which are pivotally connected together medially along their respective longitudinal axis. Further, the longitudinal beams 102 are pivotally connected to the transverse beams 110 so that when the bed frames 100, 200, 300, 400, 500 and 600 are folded to a reduced size, each of the longitudinal and transverse bars can be folded compactly together in generally three folding steps and the overall dimensions of the folded bed frames 100, 200, 300, 400, 500 and 600 can be minimized to a configuration that not only facilitate reduced storage space but also makes transporting the bed frames 100, 200, 300, 400, 500 and 600 easier.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A foldable bed frame comprising:

first, second and third longitudinal beams spaced apart and parallel to each other, the third longitudinal beam positioned between the first and second longitudinal beams, each longitudinal beam formed by first and second longitudinal bars each having a first end and a second end, adjacent first ends of each first and second longitudinal bars pivotally connected together by a first pivotal coupling member;

first and second transverse beams spaced apart and parallel to each other, each transverse beam formed by a pair of transverse bars having a first end and a second end, adjacent first ends of each pair of transverse bars pivotally connected together by a second pivotal coupling member, opposing transverse bar second ends of each transverse beam pivotally connected to longitudinal bar second ends of opposing first and second longitudinal beams by a third pivotal coupling member to form a generally rectangular frame forming an inner space therebetween when the bed frame is in an open configuration; and a plurality of legs, wherein each of the plurality of legs is coupled to a corresponding lower side of each longitudinal bar proximate the second ends and extending downward therefrom;

wherein the bed frame is folded from the open configuration to a folded configuration by:

rotating each of the plurality of legs towards its corresponding longitudinal bar;

rotating downward, with respect to respective second pivotal coupling members, each pair of unfolded transverse bars of each of the first and second transverse beams to be folded;

rotating downward, with respect to respective third pivotal coupling members, each pair of folded transverse bars towards the first and second longitudinal beams to fold the longitudinal bars of the third longitudinal beam; and collectively rotating the opposing longitudinal bars of the first and second longitudinal beams and the folded transverse beams toward the folded longitudinal bars of the folded third longitudinal beam such that the transverse bars and the longitudinal bars are collectively substantially parallel and adjacent to each other.

2. The foldable bed frame of claim 1, wherein rotating downward each pair of unfolded transverse bars comprises:

rotating downward each pair of unfolded transverse beams such that the transverse bars of each transverse beam are substantially parallel and adjacent to each other and opposing first and second longitudinal beams are substantially parallel and adjacent to each other.

3. The foldable bed frame of claim 1, wherein rotating downward each pair of folded transverse bars comprises:

simultaneously rotating the longitudinal bars of the third longitudinal beam downward with respect to the first pivotal coupling member of the third longitudinal beam such that each pair of folded transverse bars are substantially parallel and adjacent to the longitudinal bars of opposing first and second longitudinal beams, and the folded longitudinal bars of the third longitudinal beam are substantially parallel and adjacent to each other and positioned substantially perpendicular to the first and second longitudinal beams and the folded transverse beams.

4. The foldable bed frame of claim 1, wherein at least one transverse bar of each transverse beam is adjustable in length.

5. The foldable bed frame of claim 4, wherein the at least one transverse bar comprises at least two sections slidably coupled together.

6. The foldable bed frame of claim 1, wherein each of the plurality of legs comprises a side plate having an elongated channel with opposing ends.

7. The foldable bed frame of claim 6, wherein the side plate of each respective leg is integrally formed thereto and extends upwardly.

8. The foldable bed frame of claim 6, wherein the channel is formed with a uniform width and each channel end has a substantially circular aperture integrally formed with the channel and having a diameter greater than the width of the channel.

9. The foldable bed frame of claim 8, further comprising a locking device having an inner end and an outer end, wherein the locking device extends through opposing side portions of the longitudinal bar second end and through the channel.

10. The foldable bed frame of claim 9, wherein the locking device outer end has an inner portion having a diameter substantially similar to the channel width and an outer portion having a diameter greater than the channel width such that the side plate and each respective plurality of legs are locked in an operating state and pivotable to a folded state.

* * * * *